US010274185B2

(12) United States Patent
Kato et al.

(10) Patent No.: US 10,274,185 B2
(45) Date of Patent: Apr. 30, 2019

(54) LIGHTING DEVICE

(71) Applicants: KABUSHIKI KAISHA TOSHIBA, Tokyo (JP); TOSHIBA MATERIALS CO., LTD., Yokohama-Shi, Kanagawa (JP)

(72) Inventors: Mitsuaki Kato, Kawasaki Kanagawa (JP); Hiroshi Ohno, Yokohama Kanagawa (JP); Katsumi Hisano, Matsudo Chiba (JP); Hiroyasu Kondo, Yokohama Kanagawa (JP); Ryoji Tsuda, Fujisawa Kanagawa (JP)

(73) Assignees: Kabushiki Kaisha Toshiba, Minato-Ku (JP); Toshiba Materials Co., Ltd., Yokohama-Shi (JP)

( * ) Notice: Subject to any disclaimer, the term of this patent is extended or adjusted under 35 U.S.C. 154(b) by 52 days.

(21) Appl. No.: 15/262,427

(22) Filed: Sep. 12, 2016

(65) Prior Publication Data

US 2016/0377278 A1 Dec. 29, 2016

Related U.S. Application Data

(63) Continuation of application No. PCT/JP2014/076173, filed on Sep. 30, 2014.

(30) Foreign Application Priority Data

Mar. 28, 2014 (JP) ..... 2014-069100

(51) Int. Cl.
*F21K 9/66* (2016.01)
*F21K 9/90* (2016.01)
(Continued)

(52) U.S. Cl.
CPC ..... *F21V 29/89* (2015.01); *F21K 9/232* (2016.08); *F21K 9/66* (2016.08); *F21K 9/90* (2013.01);
(Continued)

(58) Field of Classification Search
None
See application file for complete search history.

(56) References Cited

U.S. PATENT DOCUMENTS 8,487,518 B2 7/2013 Johnston et al.
2010/0213881 A1 8/2010 Imai
(Continued)

FOREIGN PATENT DOCUMENTS

CN 102159872 A 8/2011
CN 202769315 U 3/2013
(Continued)

OTHER PUBLICATIONS

Extended European Search Report (Application No. 14887313.6) dated Oct. 4, 2017.
(Continued)

*Primary Examiner* — Britt D Hanley
(74) *Attorney, Agent, or Firm* — Burr & Brown, PLLC

(57) ABSTRACT

According to one embodiment, a lighting device includes a hollow globe having an opening at an end thereof, a light source housed in the globe and including at least an LED, a pillar portion housed in the globe and supporting the light source, a cap connector directly connected to the pillar portion, or indirectly connected to the pillar portion via another member, and a cap attached to the cap connector and electrically connected to the light source. A thermally conductive layer is provided between the inner surface of the globe and the lateral surface of the pillar portion.

2 Claims, 22 Drawing Sheets

(51) Int. Cl.

| | |
|---|---|
| ***F21V 3/00*** | (2015.01) |
| ***F21V 3/02*** | (2006.01) |
| ***F21K 9/232*** | (2016.01) |
| ***F21V 29/70*** | (2015.01) |
| ***F21V 29/89*** | (2015.01) |
| ***F21Y 115/10*** | (2016.01) |

(52) U.S. Cl.
CPC ..... *F21V 3/02* (2013.01); *F21V 29/70* (2015.01); *F21V 3/00* (2013.01); *F21Y 2115/10* (2016.08)

(56) References Cited

U.S. PATENT DOCUMENTS

| | | | |
|---|---|---|---|
| 2011/0074290 | A1 | 3/2011 | Sakai et al. |
| 2011/0169406 | A1 | 7/2011 | Weekamp et al. |
| 2012/0014111 | A1 | 1/2012 | Welten |
| 2012/0061067 | A1 | 3/2012 | Tominaga et al. |
| 2012/0162965 | A1 | 6/2012 | Takeuchi et al. |
| 2012/0218768 | A1 | 8/2012 | Hisano et al. |
| 2013/0051003 | A1 | 2/2013 | Fan |
| 2013/0188333 | A1 | 7/2013 | Ooya et al. |
| 2013/0223077 | A1 | 8/2013 | Kato et al. |
| 2014/0001945 | A1 | 1/2014 | Yamamoto et al. |
| 2014/0362599 | A1 | 12/2014 | Ohno et al. |

FOREIGN PATENT DOCUMENTS

| | | | |
|---|---|---|---|
| EP | 2 998 639 | A1 | 3/2013 |
| EP | 3 037 714 | A1 | 6/2016 |
| EP | 3 037 718 | A1 | 6/2016 |
| JP | 2009-135026 | A1 | 6/2009 |
| JP | 2010-199145 | A1 | 9/2010 |
| JP | 2011-070971 | A1 | 4/2011 |
| JP | 2012-028245 | A1 | 2/2012 |
| JP | 2012-064496 | A1 | 3/2012 |
| JP | 2012-064658 | A1 | 3/2012 |
| JP | 2012-113943 | A1 | 6/2012 |
| JP | 2012-181966 | A1 | 9/2012 |
| JP | 2012-212682 | A1 | 11/2012 |
| JP | 2012-221847 | A1 | 11/2012 |
| JP | 2012-243643 | A1 | 12/2012 |
| JP | 2013-020813 | A1 | 1/2013 |
| JP | 2013-026050 | A1 | 2/2013 |
| JP | 2013-026053 | A1 | 2/2013 |
| JP | 5189211 | B2 | 4/2013 |
| JP | 2013-142892 | A1 | 7/2013 |
| JP | 2013-175406 | A1 | 9/2013 |
| JP | 2014-216259 | A1 | 11/2014 |
| JP | 2014-241227 | A1 | 12/2014 |
| WO | 2010/032181 | A1 | 3/2010 |
| WO | 2013/132549 | A1 | 9/2013 |
| WO | 2013/175689 | A1 | 11/2013 |
| WO | 2015/019682 | A1 | 2/2015 |
| WO | 2015/019683 | A1 | 2/2015 |
| WO | 2015/020229 | A1 | 2/2015 |
| WO | 2015/020230 | A1 | 2/2015 |

OTHER PUBLICATIONS

English translation of International Preliminary Report on Patentability (Chapter I) (Application No. PCT/JP2014/076173) dated Oct. 13, 2016.

Chinese Office Action (Application No. CN 201480076541.0) dated Aug. 27, 2018 (with English translation).

LIGHTING DEVICE

CROSS REFERENCE TO RELATED APPLICATIONS

This application is a Continuation application of PCT Application No. PCT/JP2014/076173, filed Sep. 30, 2014 and based upon and claiming the benefit of priority from Japanese Patent Application No. 2014-069100, filed Mar. 28, 2014, the entire contents of all of which are incorporated herein by reference.

BACKGROUND OF THE INVENTION

Field of the Invention

Embodiments described herein relate generally to a lighting device.

Description of Related Art

In general, in a lighting device using a light-emitting diode (LED), the LED is provided on a surface of a base, and a spherical globe is provided to cover the LED and to diffuse and externally emit light therefrom. In this lighting device, the heat of the LED is transferred to the base, and is dissipated externally through the other surface (thermal dissipation surface) of the base that is exposed to the external air.

SUMMARY OF THE INVENTION

In such lighting devices using LEDs, there is a demand for realizing substantially the same luminous intensity distribution angle (the luminous intensity distribution angle is a scale indicating the degree of spread of the light emitted from the LED), total flux (the total flux indicates a scale indicating the degree of brightness of the light emitted from the LED), and clearness (the clearness is a scale indicating the ratio of an area of the lighting device through which light passes), as a common lighting device using, for example, a filament (e.g., an incandescent bulb). In the incandescent bulb, light is emitted from the center of a globe where the filament is positioned, and the position of the light source coincides with the center of the globe.

In the lighting device using the LED, in order to increase the luminous intensity distribution angle, it is necessary to increase the area of the outer surface of a globe from which light is emitted lastly, and to perform luminous intensity distribution control so that the light emitted forward from the light emission surface of the LED will spread in all directions as far as possible.

Further, in order to increase the total flux, it is necessary to use a high-output LED, which inevitably increases the amount of heat produced by the LED. The heat produced by the LED influences the LED element itself and/or a circuit board including, for example, a power supply circuit, which may degrade the performance of the LED element and the circuit board. To avoid this, it is desirable to improve the thermal dissipation performance of the lighting device by increasing the area of the thermal dissipation surface of the base.

Furthermore, in order to improve the clearness, it is necessary to increase the ratio of the globe surface to the outer surface of the lighting device, and also to reduce the surface area of an opaque member provided in the globe. In order to locate the light source at the center of the globe, it is desirable to form a structure that can effectively transfer the heat of the light source to the globe and a cap, and enables the opaque member not to interrupt the light emitted from the center of the globe.

DETAILED DESCRIPTION OF THE INVENTION

Embodiments will be described with reference to the accompanying drawings.

In the specification, some elements are exemplarily expressed in a plurality of ways. These ways are not definitive and do not exclude the elements from being expressed in other ways. Elements not expressed by a plurality of expressions may be expressed by other expressions.

First Embodiment

Figure 1:
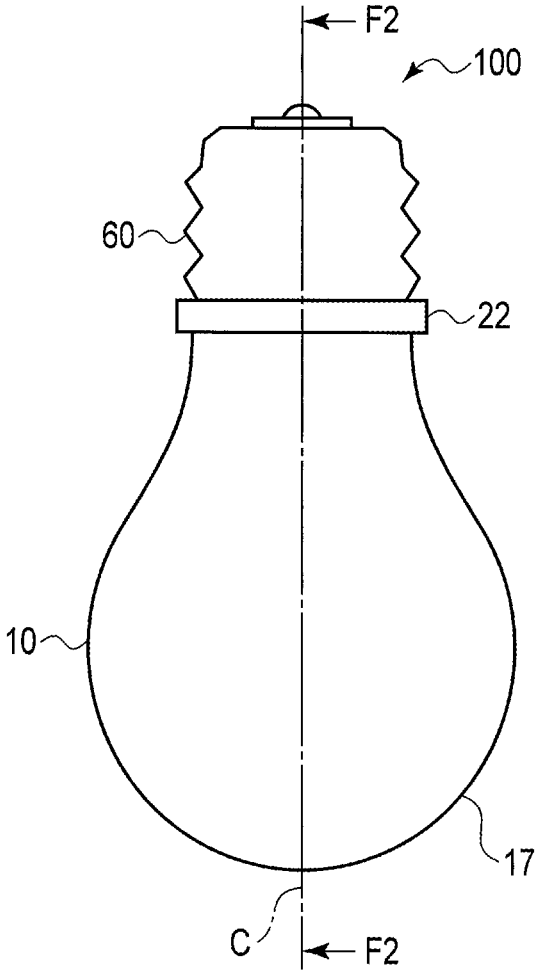
FIG. 1 is a front view showing a lighting device according to a first embodiment.
Figure 2:
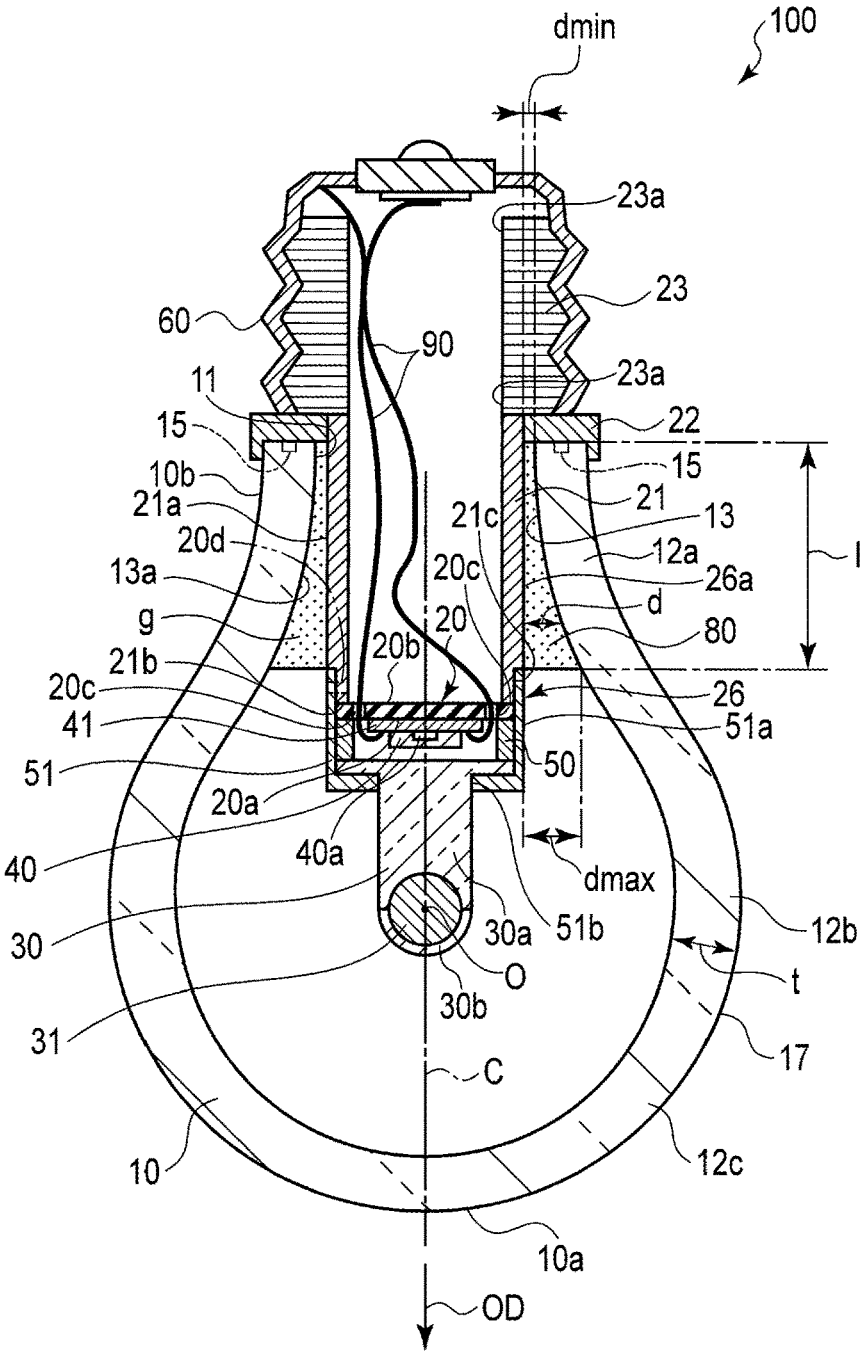
FIG. 2 is a cross-sectional view taken along line F2-F2 of the lighting device shown in FIG. 1.
Figure 3:
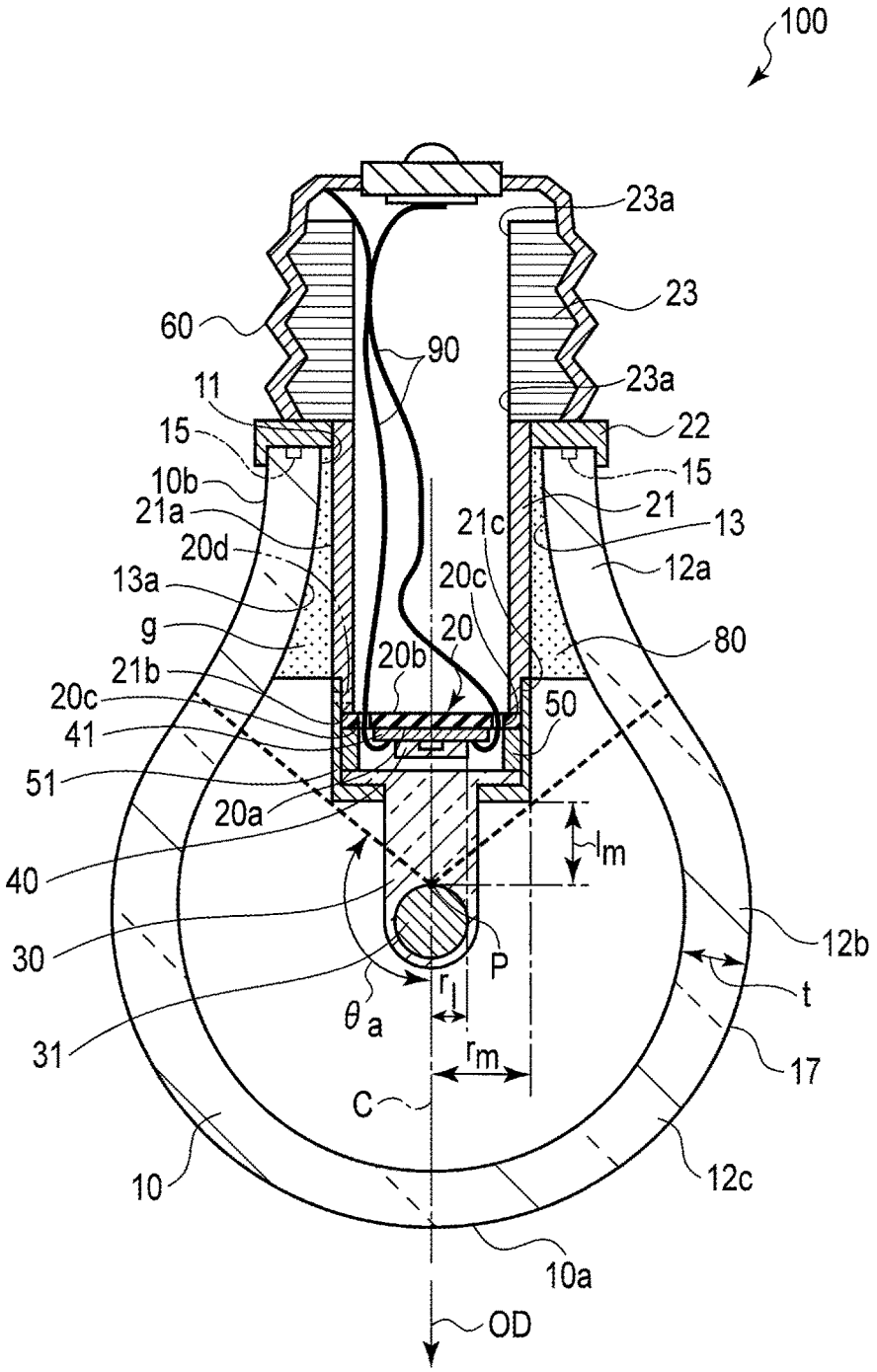
FIG. 3 is a cross-sectional view taken along line F2-F2 of the lighting device shown in FIG. 1.

FIG. 1 shows the appearance of a lighting device 100 according to the first embodiment. FIGS. 2 and 3 show cross sections taken along line F2-F2 of the lighting device 100 shown in FIG. 1. FIG. 2 shows the thickness of a thermally conductive layer 80, and FIG. 3 shows the relationship between the luminous intensity distribution angle and the component arrangement.

The lighting device 100 described in the embodiment is an LED lamp used, fitted in a socket provided in, for example, the ceiling of a room. The lighting device 100 of the embodiment is a so-called retrofit LED lamp in which the way of spread of light and the way of lighting are made close to those of an incandescent lamp. The structure of the lighting device 100 is not limited to the above, but is widely applicable to various types of lighting devices (light emitting devices).

As shown in FIG. 1, the lighting device 100 of the embodiment comprises a globe 10 and a cap 60. The globe 10 has a spherical outer shape similar to the outer shape of, for example, an incandescent lamp, and is formed of a transparent or translucent material, or of clear glass or frost glass. The globe 10 externally emits from its surface light emitted from a light source 40 (described later) located in the globe 10.

The cap 60 serves as an electrical and mechanical connection section when it is fixed to a socket (not shown) by, for example, screwing. In addition, in the embodiment, the lighting device 100 has a shape substantially symmetrical with respect to a central axis C.

As shown in FIG. 1, where the lighting device 100 is fitted in the socket, with the central axis C made parallel with the direction of gravity, the cap 60 is located in an upper position and the globe 10 is located in a lower position. When power is fed to the socket (not shown) from, for example, a power source in the room, light is emitted from the light source 40 provided in the globe 10, and is then externally emitted through the surface of the globe 10, whereby the lighting device 100 functions as lighting.

As shown in FIG. 2, the globe 10 is a hollow member. The globe 10 has a spherical apex portion 10*a*, and an opening 11 at an end (end 10*b*) opposite to the top portion 10*a*. The diameter of the opening 11 is equal to the diameter of the opening of the cap 60.

Along the optical axis OD of the light source 40, the globe 10 comprises an enlarged portion 12*a* having a circumferential length gradually enlarged from the opening 11 toward the apex 10*a* (the "circumferential length" is measured when each portion of the globe is viewed in a plane perpendicular to the central axis C of the optical axis OD), a largest portion 12*b* having a maximum outer circumferential length, and a reduced portion 12*c* having a circumferential length gradually reduced toward the apex 10*a*. The optical axis OD of the light source 40 extends between the end 10*a* (opening 11) of the globe 10 and the apex portion 10*a* of the same, and coincides with the central axis C of the lighting device 100.

As shown in FIG. 2, the lighting device 100 of the embodiment further comprises a plate-like base 20 provided in the globe 10, a substrate 41 provided on the base 20, the light source 40 provided on the substrate 41, wires 90 electrically connected to the light source 40, a lightguide column 30 having optical transparency, a lens connector 51 adjacent to the base 20 and fixing the lightguide column 30, a pillar 21 supporting the base 20, a globe connector 22 supporting the globe 10, and a cap connector 23 connected to the pillar 21 to connect the pillar 21 to the cap 60. The cap connector 23 may be connected to the globe connector 22, instead of the pillar 21 or in addition to the pillar 21, thereby connecting the globe connector 22 to the cap 60.

The base 20 is attached to the pillar 21 and supports the light source 40. The base 20 is a member having a flat shape for placing the substrate 41 thereon, and internally conducts the heat of the light source 40 to the pillar 21. The base 20 comprises a first surface 20*a* (for example, a lower surface) positioned close to the light source 40, and a second surface 20*b* (for example, an upper surface) positioned on the opposite side of the first surface 20*a*. The base is formed of a material excellent in thermal conduction, such as an aluminum alloy or a copper alloy.

As shown in, for example, FIG. 2, the base 20 may be a substantially disk member or a polygonal member, as is shown in FIG. 2. A screw hole, a screw box or a hole may be formed in part of the base 20 for enabling the same to be connected to, for example, the lens connector 51 and the pillar 21.

Moreover, the base 20 has through holes 20*c* formed to permit the wires 90 to be guided from the second surface 20*b* to the first surface 20*a*. Instead of providing the through holes 20*c* in the base 20, a hole 20*d* may be formed in the lateral surface 21*a* of the pillar 21, and holes (not shown) may be formed in the lens connector 51 and a substrate connector 50, thereby passing the wires 90 through the holes including the hole 20*d* to the first surface 20*a* side of the base 20.

Between the first surface 20*a* of the base 20 and the lightguide column 30, the substrate connector 50 (substrate holding portion) is formed, for example. The substrate connector 50 is formed, for example, annularly to surround the substrate 41, and is held between the base 20 and the lightguide column 30 to form a space for receiving the substrate 41 and the light source 40. The substrate connector 50 will be described later in detail. The pillar 21 may not be inserted from the cap 60 to the light source 40, but may have a surface kept in contact with the second surface 20*b* of the base 20. In this case, the thermal resistance between the pillar 21 and the base 20 decreases. Further, the pillar 21 and the base 20 may be formed integral as one body. In this case, the thermal resistance between the pillar 21 and the base 20 can further decrease.

As shown in FIG. 3, in one viewpoint, it is preferable that the outer circumferential length of the base 20 is not less than each of the outer circumferential lengths of the light source 40, the substrate 41 and the substrate connector 50, and is close, as far as possible, to the inner circumferential length of the opening 11 of the globe 10 within a range defined by lines 70 that extend along the intensity distribution of light emitted from the origin P of a scattering member 31 (described later) included in the optical conduction column 30. In this structure, the surface area of the base 20 is large and hence its contact thermal resistance against the pillar 21 is small, which means that the thermal dissipation performance of the lighting device 100 high. Further, within a range in which the lighting device 100 can exhibit a sufficient thermal dissipation performance, that is, within a range in which the calorific power of electrical circuits contained in the light source 40 and the pillar 21 does not exceed the thermal resistance temperatures of the light source 40 and the electrical circuits, it is desirable to set the outer circumferential length of the base 20 close, as far as possible, to each of the outer circumferential lengths of the light source 40, the substrate 41 and the substrate connector 50. In this case, the lighting device 100 exhibits a sufficient transparency.

In this embodiment, the "origin of a scattering member" is set to, for example, a point of the scattering member 31 close to the cap 60. The "range defined by lines 70 that extend along the luminous intensity distribution" means a range in which light beams (light beams along the lines 70) defined by a luminous intensity distribution angle that is twice the angle between the optical axis OD and each light beam are not interrupted, that is, means a range closer to the central axis C than the lines 70. For example, in the case of an incandescent lamp, its luminous intensity distribution angle is generally not less than 270°, and it is desirable that the luminous intensity distribution angle of the embodiment fall within this range. However, the luminous intensity distribution angle of the embodiment is not limited to it.

A detailed description will now be given of the pillar 21, the globe connector 22 and the cap connector 23.

As shown in FIG. 2, the pillar 21 is formed as, for example, a cylindrical and hollow member. The pillar 21 is located between the opening 11 of the globe 10 and the light source 40. The pillar 21 supports the light source 40 within the globe 10, and is thermally connected to the light source 40. In the embodiment, the pillar 21 comprises the lateral surface 21*a* extending substantially parallel to the central axis C, and an edge surface 21*b* extending, for example, perpendicularly to the central axis C. The edge surface 21*b* of the pillar 21 is in contact with the second surface 20*b* of the base 20, and supports the base 20.

Thus, the pillar 21 supports the light source 40 through the base 20 and the substrate 41, and is thermally connected to the light source 40. As the material of the pillar 21, a material excellent in thermal conduction, such as an aluminum alloy or a copper alloy, is used. The pillar 21 transfers therein the heat of the light source 40, and transfers part of the heat to the globe 10 and the cap 60.

In one viewpoint, it is preferable that the outer circumferential length of the pillar 21 is not less than each of the outer circumferential lengths of the light source 40, the substrate 41 and the substrate connector 50, and is close, as far as possible, to the inner circumferential length of the opening 11 of the globe 10 within a range defined by lines 70 that extend along the intensity distribution of light emitted from the origin P of the scattering member 31 of the lightguide column 30. In this structure, the surface area of the pillar 21 is large and hence its contact thermal resistance against the globe 10 is small, which means that the thermal dissipation performance of the lighting device 100 high. Further, within a range in which the lighting device 100 can exhibit a sufficient thermal dissipation performance, that is, within a range in which the calorific power of electrical circuits contained in the light source 40 and the pillar 21 does not exceed the thermal resistance temperatures of the light source 40 and the electrical circuits, it is desirable to set the outer circumferential length of the pillar 21 close, as far as possible, to each of the outer circumferential lengths of the light source 40, the substrate 41 and the substrate connector 50. In this case, the lighting device 100 exhibits a sufficient transparency. The outer circumferential length of the pillar 21 may vary along the central axis C. In this case, the outer circumferential length of the pillar 21 is set within a range defined by the lines 70 representing the luminous intensity distribution. The outer circumferential length of the pillar 21 means the circumferential length of the same as viewed in a plane perpendicular to the central axis of the same.

Although the inside of the pillar 21 is filled with, for example, air, it may be filled with a gas other than air, such as helium, or with pressurized gas. The inside of the pillar 21 may also be filled with a liquid, such as water, silicone grease or fluorocarbon. The inside of the pillar 21 may further be filled with a plastic material as a synthetic resin (high polymer compound), such as acrylic resin, epoxy resin, polybutylene terephthalate (PBT), polycarbonate, or polyetheretherketone (PEEK), or an elastomer, such as silicone rubber or urethane rubber. The inside of the pillar 21 may further be filled with a metal, such as aluminum or copper, or with glass. Since these materials have a higher thermal conductivity than air, thermal conduction is accelerated. If a material having a high electrical insulation property is used, the power circuit can be electrically insulated. Further, a heat pump may be provided in the pillar 21 to further accelerate thermal conduction.

The surface of the pillar 21 may be covered with a radiation layer having a high radiation property, such as an alumite layer formed by a surface treatment, or covered with painting. If a material having a low visible-light absorbency, such as white paint, is used as the material of the radiation layer, loss of light on the surface of the pillar 21 can be reduced. The surface of the pillar 21 may be made glossy by polishing, coating, metal deposition, etc. In this case, radiation is suppressed, but loss of light on the surface of the globe connector 22 can be reduced. In the description below, the surface of the pillar 21 that defines the cavity therein will be referred to as an inner surface, and the surface of the same opposite to the inner surface will be referred to as an outer surface.

As shown in FIG. 2, the lateral surface 21*a* of the pillar 21 faces the inner surface 13 of the globe 10 along a line (for example, a horizontal line) crossing the central axis C. The lateral surface 21*a* of the pillar 21 faces, for example, the inner surface 13*a* of the enlarged portion 12*a* of the globe 10.

The globe connector 22 (a globe holding portion or a flange) is attached to the end 10*b* of the globe 10, and fixes the globe 10 and the pillar 21. The globe connector 22 has, for example, a portion that is in contact with the end 10*b* of the globe 10, and a portion that is in contact with the lateral surface 21*a* of the pillar 21. As the material of the globe connector 22, a material excellent in thermal conduction, such as an aluminum alloy and a copper alloy, is used. Part of the heat produced by the light source 40 is transferred to the globe connector 22 via the pillar 21, and then to the globe 10.

More specifically, the globe connector 22 has a substantially cylindrical shape as shown, for example in FIG. 2. The globe connector 22 may be formed integral with the pillar 21 as one body, or may have a screw hole, a screw box or a hole for enabling itself to be connected to the pillar 21. The globe connector 22 may also have a thermal connection portion 15 that includes a projection, a recess, etc. for increasing a contact area between the connector 22 and the globe 10.

An adhesive having a thermal resistance, for example, is used for connecting the globe connector 22 and the globe 10. Alternatively, the opening 11 of the globe 10 may be formed to a screw form, and may be screwed into the globe connector 22. Yet alternatively, the globe 10 may be connected to the cap 60 by direct screwing or using means, such as adhesive, without using the globe connector 22. When the globe 10 is directly connected to the cap 60, the cap connector 23 is connected to the inner surface of the globe 10 by screwing or adhesion. In other words, the cap connector 23 is directly connected to the pillar 21 (pillar portion 26), or indirectly connected thereto through another member. An example of "another member" is the globe connector 22. However, the member is not limited to it, and may be the globe 10 or any other member.

In addition, a surface of the globe connector 22 exposed to air may be covered with a radiation layer having a high radiation property, such as an alumite layer formed by a surface treatment, or covered with painting. If a material having a low visible-light absorbency, such as white paint, is used for the radiation layer, loss of light on the surface of the globe connector 22 can be reduced. The surface of the pillar 21 may be made glossy by polishing, coating, metal deposition, etc. In this case, radiation is suppressed, but loss of light on the surface of the globe connector 22 can be reduced.

The cap connector 23 (cap holding portion) is connected to either the pillar 21 or the globe connector 22. The cap connector 23 is a member, for example, that can be screwed into the cap 60, and transfers therethrough the heat of the light source 40 to the cap 60. The cap connector 23 has a cylindrical shape as shown in, for example, FIG. 2, has openings 23*a* at its opposite ends. That is, the cap connector 23 has one of the openings 23*a* in a surface thereof connected to the pillar 21.

The cap connector 23 may have a screw hole, a screw box or a hole for enabling itself to be connected to, for example, at least the pillar 21, the globe connector 22, or the cap 60. As the material of the cap connector 23, a material excellent in thermal conduction, such as ceramic or a metal material (e.g., an aluminum alloy and a copper alloy), is used. The cap 60 is attached to the cap connector 23. The cap 60 is electrically connected to the light source 40 via, for example, the wires 90.

If it is necessary to electrically insulate the cap 60 from the other components, a material having a low electrical conductivity may be inserted between the cap 60 and the cap connector 23 or between the cap connector 23 and the pillar 21. Further, the cap connector 23 may be formed of a material having a low electrical conductivity, such as resin. In the description below, a surface of the cap connector 23 close to the globe connector 22 will be referred to as a lower surface, and a surface of the cap connector 23 to be engaged with the cap 60 will be referred to as a lateral surface.

A detailed description will now be given of the substrate connector 50, the lightguide column 30, the lens connector 51 and the light source 40.

The substrate connector 50 is a component for fixing the substrate 41 to the base 20. The substrate connector 50 can also be used to fix the lightguide column 30 to the substrate 41 or the base 20. The substrate connector 50 has substantially a disk shape as shown in, for example, FIG. 2. A projection (support portion) for pressing the substrate 41 against the base 40 may be provided on part of the substrate connector 50. The projection is provided to avoid the light emission surface of the light source 40, and an electrode portion on the substrate 41.

The substrate connector 50 may have a screw hole, a screw box or a hole for enabling itself to be connected to the base 20. As the material of the substrate connector 50, a plastic material excellent in strength and thermal resistance, such as polycarbonate, a ceramic, or a metal material (e.g., an aluminum alloy and a copper alloy) excellent in thermal conduction, is used.

If it is necessary to electrically insulate the substrate connector 50, the light source 40 and the substrate 41, a material having a low electrical conductivity may be inserted between the substrate connector 50 the substrate 41, or the substrate connector 50 may be formed of a material having a low electrical conductivity, such as resin.

When the lightguide column 30 is fixed, the substrate connector 50 serves as a spacer around the substrate 41 and the light source 40. Further, when the lightguide column 30 is formed of a resin and the base is formed of a metal, if the substrate connector 50 made of a resin is fixed to the base 20 with a screw, and the lightguide column 30 and the substrate connector 50 are adhered to each other with an adhesive, secure adhesion is realized. This is because in this case, members of the same material are adhered with an adhesive, and members of different materials are screwed to each other.

In addition, a screw hole may be directly formed in the lightguide column 30, thereby screwing the column 30 and the base 20 using a screw. In this case, however, the screw hole and the screw may reflect or absorb light, thereby making it difficult for the lightguide column 30 to control luminous intensity distribution. The substrate connector 50 may have a recess (or projection) to be engaged with the projection (or recess) at the edge surface of the lightguide column 30. In this case, the lightguide column 30 is fixed, held between the substrate connector 50 and the lens connector 51. Thus, positive fixation and easy luminous intensity distribution control can be realized using the substrate connector 50. In the description below, a surface of the substrate connector 50 close to the light source 40 is defined as a lower surface, and a surface of the connector 50 opposite to the lower surface is defined as an upper surface.

The lightguide column 30 is an example of a "lightguide member." The lightguide column 30 comprises a plurality of component parts including, for example, a base portion 30*a* and a tip portion 30*b* formed as a member different from the base portion 30*a*, the portions 30*a* and 30*b* being bonded to each other to define a cavity therebetween. The scattering member 31 is inserted in this cavity, for example. The scattering member 31 has a structure obtained by sealing, using a transparent resin, a spherically rounded titanium oxide powder having a particle diameter of, for example, about 1 to 10 μm. Alternatively, the scattering member 31 may be formed by sandblasting or painting the inner surface of the cavity. That is, the scattering member 31 may be formed of the inner surface (diffusing surface) of the cavity subjected to a predetermined process.

Light guided from the light source 40 to the lightguide column 30 is diffused in the cavity thereof and externally emitted. The lightguide column 30 enables light to be emitted from a position away from the light source 40, which makes the appearance of the LED closer to an incandescent lamp. The lightguide column 30 may comprise only the base portion 30*a*, without the tip portion 30*b*. In this case, the scattering member 31 (diffusing surface) may be formed of, for example, a recess formed in the base portion 30*a*. A projection to be secured to the lens connector 51 and the substrate connector 50 may be provided on an end face of the lightguide column 30.

If, for example, the central point O of luminous intensity distribution of the lightguide column 30 is provided to coincide with the center of the globe 10, the light from the light source 40 is emitted through the central point O, i.e., the center of the globe 10. The maximum diameter of the lightguide column 30 is set not greater than the diameter of the opening 11 of the globe 10. As a result, the lightguide column 30 can be inserted into the globe 10. It is preferable to use, as the material of the lightguide column 30, acrylic, polycarbonate, cycloolefin polymer, glass, etc., which have a high light transmissivity.

The lens connector 51 (a cover, a holding cover) is attached to the lower end of the pillar 21 to secure the lightguide column 30 (lightguide member). More specifically, the lens connector 51 is a member for preventing leakage of light through a clearance between the light source 40 and the lightguide column 30, fixing the lightguide column 30 to the base 20, and dissipating the heat of the light source 40 to the glove 10, like the pillar 21, while preventing the light leaking. The lens connector 51 is formed substantially cylindrically as shown in, for example, FIG. 2.

More specifically, the lower end of the pillar 21 includes an attaching portion 21*c* that has an outer diameter smaller than the other portion by, for example, the thickness of the lens connector 51. The lens connector 51 is attached to the attaching portion 21*c* of the pillar 21 and supported by the pillar 21. Thus, the lens connector 51 has a lateral surface 51*a* extending continuously with, for example, the lateral surface 21*a* of the pillar 21. The lateral surface 51*a* of the lens connector 51 faces the inner surface 13 of the globe 10 along a line (for example, a horizontal line) crossing the central axis C. The lateral surface 51*a* of the lens connector 51 faces, for example, the inner surface 13*a* of the enlarged portion 12*a* of the globe 10.

In other words, the lighting device 100 has a pillar part 26 (an entire support, a support portion, a light source support portion) that comprises the pillar 21 and the lens connector 51. The pillar portion 26 is inserted in the globe 10, and extends along the central axis C. The pillar portion 26 may have a columnar or rectangular columnar contour, or may have a contour that varies along the central axis C. In this case, the outer circumferential length of the pillar portion 26 is set to fall within a range defined by the lines 70 along the luminous intensity distribution. The outer circumferential length of the pillar portion 26 means the circumferential length of a cross section of the same perpendicular to the central axis of the same. The lateral surface 26*a* of the pillar portion 26 includes the lateral surface 21*a* of the pillar 21 and the lateral surface 51*a* of the lens connector 51.

On the other hand, the lens connector 51 has an opening 51*b* through which the lightguide column 30 is passed. The lightguide column 30 is passed through the opening 51*b* of the lens connector 51 to the outside of the lens connector 51.

The lens connector 51 may have a screw hole, a screw box or a hole for enabling itself to be connected to the pillar 21 or the substrate connector 50. Further, a recess (or projection) to be engaged with the projection (or recess) at the edge surface of the lightguide column 30 may be provided at part of the lens connector 51. In this case, the lightguide column 30 is secured between the substrate connector 50 and the lens connector 51.

The lens connector 51 is formed of an opaque material that does not pass leakage light, or of a material coated with opaque paint. As the material of the lens connector 51, a synthetic resin excellent in strength and thermal resistance, such as polycarbonate, or a material excellent in thermal conduction, such as an aluminum alloy or a copper alloy, is used. The outer and inner surfaces of the lens connector 51 may be provided with radiation layers (not shown). The radiation layers are formed, for example, of alumite resulting from surface treatment, or by painting. If a material having a low visible-light absorbency, such as white paint, is used as the material of the radiation layer, loss of light on the surface of the lens connector 51 can be reduced. The outer and inner surfaces of the lens connector 51 may be formed to be glossy surfaces by polishing, painting, metal deposition, etc. In this case, the loss of light on the lens connector 51 can be reduced, although radiation is suppressed.

The light source 40 is a component in which one or a plurality of light emitting elements 40*a*, such as LEDs, are mounted on the plate-like substrate 41, and emits visible light, such as white light. For instance, when the light emitting element 40*a* emits blue-violet light with a wavelength of 450 nm, the light source 40 produces white light if it is covered with, for example, a resin material containing a fluorescent material that absorbs blue-violet light and emits yellow light with a wavelength of about 560 nm.

If the substrate 41 is formed of a material having a high electrical conductivity, such as a metal, it is preferable to place the substrate 41 so that a surface thereof opposite to the surface provided with the light source 40 is kept in contact with the base 20, with an electrically insulated and highly thermally conductive sheet interposed therebetween. This is because in order to transfer the heat of the light source 40 to the base 20, it is preferable that the contact thermal resistance between the light source 40 and the base 20 is small, and that the light source 40 and the base 20 are electrically insulated from each other, as will be described later. In addition, if the substrate 41 is formed of a material having a low electrical conductivity, such as ceramic, the above-mentioned insulating sheet is dispensable.

Figure 4:
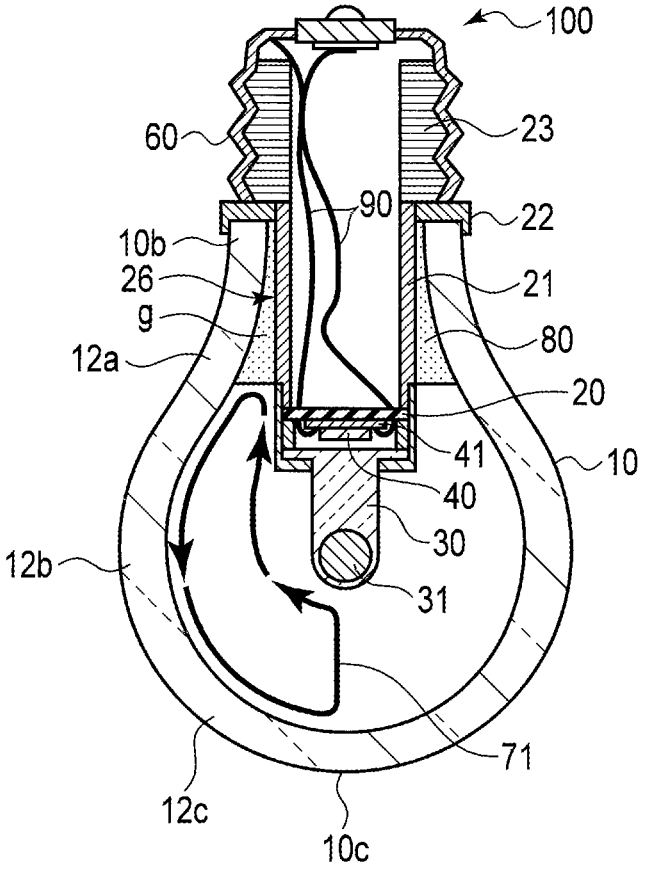
FIG. 4 is a cross-sectional view showing a convection flow occurring in the lighting device shown in FIG. 1.

FIG. 4 shows convection occurring inside the lighting device 100 shown in FIG. 1. As indicated by a streamline 71 in FIG. 4, the air near the lightguide column 30 is reduced in density by the heat produced by the lightguide column 30, and flows in a direction opposite to the direction of gravity. Further, the heat of the air near the globe 10 is absorbed by the globe 10 whose temperature is lower than the air, whereby the density of the air increases and flows in the same direction as that of gravity. By this cycle of thermal dissipation from the pillar 21 to the globe 10, the light source 40 can be efficiently cooled.

An electrical circuit for supplying electrical power to the light source 40 may be contained in the cap 60, the cap connector 23 or the pillar 21. The electrical circuit receives an alternating voltage (for example, 100V), converts the same into a direct voltage, and applies the direct voltage to the light source 40 via the wires 90. In that case, electrical power can be supplied to the light source 40 without using an external power supply. Moreover, arbitrary devices, as well as a power supply circuit, may be provided in an arbitrary combination of the cap 60, the cap connector 23 and the pillar 21. For example, the arbitrary devices include a toning circuit, a light modulation circuit, a wireless circuit, a primary cell, a rechargeable cell, a Peltier device, a microphone, a loud speaker, a radio, an antenna, a clock, an ultrasonic generator, a camera, a projector, a liquid crystal display, an interphone, a fire alarm, an alarm, a gas component analysis sensor, a particle counter, a smoke sensor, a human sensing sensor, a distance sensor, an illuminance sensor, an atmospheric pressure sensor, a magnetism sensor, an acceleration sensor, a temperature sensor, a moisture sensor, a tilt sensor, an acceleration sensor, GPS, a Geiger counter, a ventilation fan, a humidifier, a dehumidifier, an air cleaner, a fire extinguishing agent, a disinfection agent, a deodorizer, a fragrance agent, an anti-insect agent, an antenna, a CPU, a memory, a motor, a propeller, a fan, a fin, a pump, a heat pump, a heat pipe, a wire, a cleaner, a dust-collecting filter, a wireless LAN access point, a repeater, an electromagnetic shield, a radio electrical supply transmitter, a radio electrical supply receiver, a photocatalyst, a solar battery, etc.

(Explanation of Thermal Conductive Layer)

Next, the thermally conductive layer 80 will be described in detail.

As shown in FIG. 2, the thermally conductive layer 80 formed of at least a gas, a liquid, a synthetic resin, glass or a metal is provided between the inner surface 13 of the globe 10 and the lateral surface 26*a* of the pillar portion 26. The thermally conductive layer 80 may be provided only between the inner surface 13 of the globe 10 and the lateral surface 21*a* of the pillar 21, and may be provided, in addition to this position, between the inner surface 13 of the globe 10 and the lateral surface 51*a* of the lens connector 51. The thermally conductive layer 80 promotes thermal dissipation from the pillar portion 26 to the globe 10.

More specifically, the thermally conductive layer 80 is provided between an area near the end 10*b* (opening 11) inside the inner surface 13 of the globe 10, and the lateral surface 26*a* of the pillar portion 26. In the embodiment, the thermally conductive layer 80 is provided, for example, between the inner surface 13*a* of the enlarged portion 12*a* of the globe 10 and the lateral surface 26*a* of the pillar portion 26.

The thermally conductive layer 80 extends, for example, along the optical axis OD over a predetermined length. In the embodiment, the pillar 21 is elongated along the optical axis OD of the light source 40. The thermally conductive layer 80 extends over, for example, substantially half or more of the length of the pillar 21 (or substantially half or more of the length of the pillar portion 26).

In the embodiment, the thermally conductive layer 80 is formed of a gas (for example, air) positioned between the inner surface 13 of the globe 10 and the lateral surface 26*a* of the pillar portion 26. That is, by narrowing the gap g between the inner surface 13 of the globe 10 and the lateral surface 26*a* of the pillar portion 26, a state in which the viscosity of gas is prevailing is realized, whereby a gas layer between the inner surface 13 of the globe 10 and the lateral surface 26*a* of the pillar portion 26, which does not substantially move, is made to function as the thermally conductive layer 80. The gas providing the thermally conductive layer 80 is not limited to air, but may be a gas having a high thermal conductivity, such as helium. Further, water, silicone grease, fluorocarbon, etc., may be sealed in the globe 10 including the thermally conductive layer 80, as well as the gas.

Specifically, supposing that the thickness the thermally conductive layer 80 (namely, the thickness of the gap g between the inner surface 13 of the globe 10 and the lateral surface 26*a* of the pillar portion 26) is d, the length of the pillar portion 26 that contacts the thermally conductive layer 80 is l, the volume expansion coefficient of the gas is β, the temperature of the lateral surface 26*a* of the pillar portion 26 is Tp, the temperature of the inner surface 13 of the globe 10 that contacts the thermally conductive layer 80 is Tg, and the dynamic viscosity coefficient of the gas is ν, various dimensions that satisfy following formula (1):

$$d \le \left(\frac{1400}{Gr_l}\right)^{\frac{1}{3.389}} l \tag{1}$$

where $Gr_l$ is a Grashof number and is given by following formula (2):

$$Gr_l = \frac{g\beta(Tp - Tg)l^3}{\nu^2} \tag{2}$$

If a member, such as a diffusion sheet 98*a* described later, is attached to the lateral surface 26*a* of the pillar portion 26, the above-mentioned "pillar portion" and "lateral surface of the pillar portion" may be paraphrased to "a member" and "the surface of the member." Further, if a member, such as a diffusion sheet 98*a* described later, is attached to the inner surface of the globe 10, the "globe 10" and "the inner surface of the globe 10" may be paraphrased to "a member" and "the surface (inner surface) of the member."

At this time, regarding the thermal conduction by the gap between the inner surface 13 of the globe 10 and the lateral surface 26*a* of the pillar portion 26, the thermal conduction becomes dominant, the thermal resistance decreases, and thermal transfer is promoted. Furthermore, since the thermal conduction at this time is irrelevant to convection, the influence upon the thermal dissipation due to a change in the attitude of the bulb can be suppressed.

A description will now be given of the derivation process of formula (1). The gas positioned between the inner surface 13 of the globe 10 and the lateral surface 26*a* of the pillar portion 26 can be regarded as a fluid layer between closed vertical parallel plates. In this case, supposing that the characteristic length is l, and the fluid layer thickness is d, it is known that when following formula (3) is satisfied, thermal conduction is dominant:

$$Gr_d \le 1400(l/d)^{0.389} \tag{3}$$

By multiplying the both sides of formula (3) by $l^3/d^3$ to thereby collect Grashof number by l, and moving d to the left side, formula (1) is derived.

If the thickness d of the thermally conductive layer 80 varies along the optical axis OD as in the embodiment, it is sufficient if the maximum thickness $d_{max}$ of the thermally conductive layer 80 satisfies formula (1).

In the embodiment, the outer diameter of the pillar portion 26 is set large, and, for example, thickness t of the globe 10 is set large, thereby causing the gap g between the inner surface 13 of the globe 10 and the lateral surface 26*a* of the pillar portion 26 to satisfy formula (1). Thickness t of the globe 10 means a thickness between the outer surface 17 of the globe 10 and the inner surface 13 of the globe 10.

On the other hand, thickness d of the thermally conductive layer 80 is set greater than, for example, the wavelength λ of the light emitted by the light source 40. That is, thickness d of the thermally conductive layer 80 is set to satisfy following formula (4):

$$\lambda \le d \tag{4}$$

Figure 26:
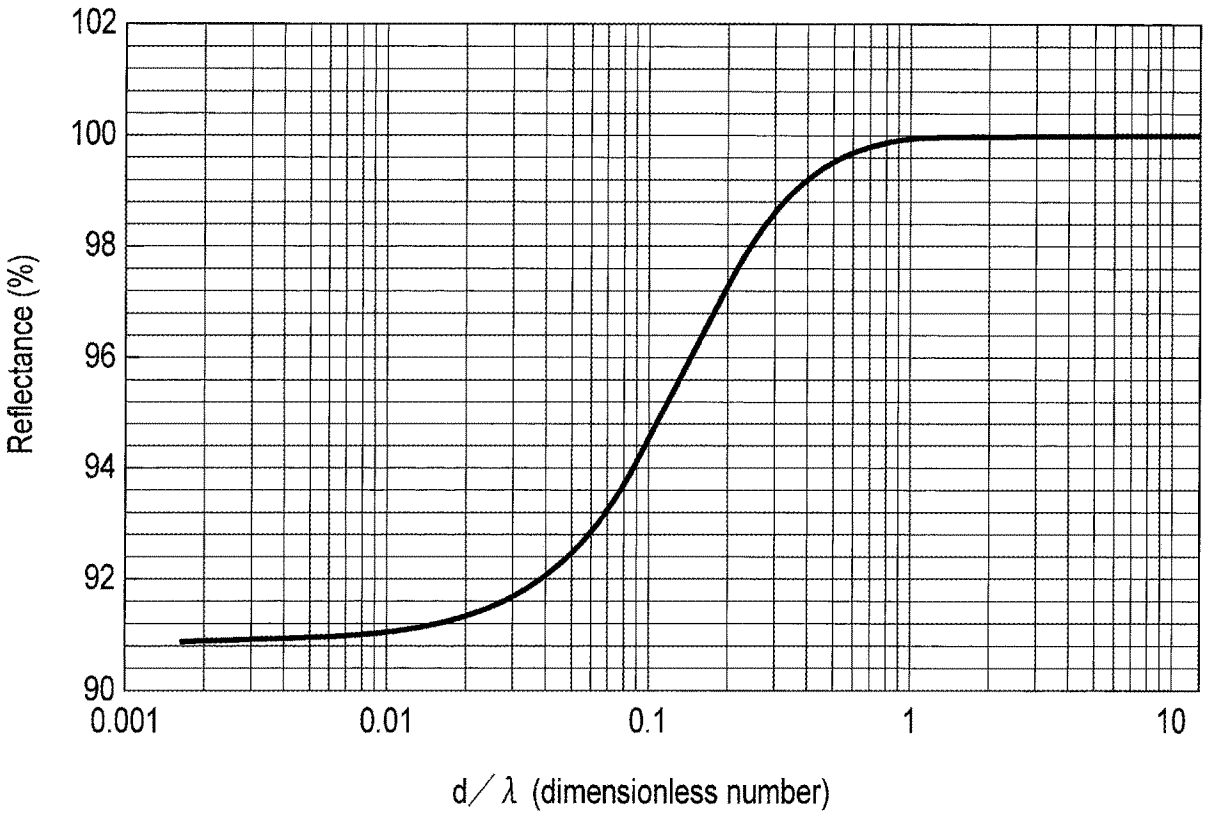
FIG. 26 is a graph showing the relationship between $d/\lambda$ and the reflectance, d being the thickness of a layer, $\lambda$ being the wavelength of light.

FIG. 26 shows the relationship between d/λ and the reflection assumed when the globe 10 and the pillar 21 are formed of acryl and aluminum, respectively, and total reflection occurs at an incident angle of 45° in the globe 10. It can be understood from FIG. 26 that when d/λ>1, i.e., d>λ, the reflection coefficient is almost 100%, while when d/λ<1, i.e., d<λ, part of light is absorbed by the pillar portion 26, and the reflection coefficient reduces when d reduces toward 0.

Therefore, in the lighting device 100 of FIG. 1, the reflection coefficient of the light transmitted in the globe 10 can be made close to 100% by providing a gap g of size d, which is larger than the wavelength of light, between the inner surface 13 of the globe 10 and the lateral surface 26*a* of the pillar portion 26. That is, most of the light transmitted in the globe 10 can be extracted as illumination light through the outer surface of the globe, thereby minimizing the loss of light due to absorption of light by the pillar 21. This means that propagation of light to the pillar portion 26 due to an evanescent wave can be prevented to thereby reduce the loss of light. At the same time, the pillar portion 26 becomes inconspicuous from the outside of the lighting device 100, which means that the lighting device 100 has a better appearance.

If thickness d of the thermally conductive layer 80 varies along the optical axis OD as in the embodiment, it is sufficient if the minimum thickness $d_{min}$ of the thermally conductive layer 80 satisfies formula (4).

Referring then to FIG. 3, a description will be given of conditions for obtaining a wider luminous intensity distribution. The light emitted from the light source 40 is irradiated around the lighting device 100 through the lightguide column 30. At this time, the origin of the distribution angle of the light from the lightguide column 30 is set to P. Further, half of the distribution angle of the light irradiated from the origin P of the lightguide column 30 is expressed as $\theta_a$. In a plane perpendicular to the central axis C of the lighting device that vertically extends and passes through the origin P of the lightguide column 30, supposing that the distance between the central axis C and an end of the cap 60, the cap connector 23, the globe connector 22, the pillar 21, the base 20, the lens connector 51, or each of the other optically opaque components, is set to $r_m$, the distance between a plane passing through the origin P of the lightguide column 30 and perpendicular to the central axis C and the above-mentioned end is $l_m$, and the minimum distance between the central axis C and a surface (e.g., an end surface) of the light source 40 opposing the lightguide column 30 is $r_l$, it is preferable that distance $r_m$ fall within a range given by following formula (5):

$$r_l \leq r_m \leq l_m |\tan \theta_a| \tag{5}$$

Distance $r_l$ to the surface of the light source 40 opposing the lightguide column 30 means a minimum distance between the above-mentioned origin as an intersection of the central axis C and the above-mentioned surface and the outer periphery of this surface. Further, distance $l_m$ between a plane passing through the origin P of the lightguide column 30 and perpendicular to the central axis C and the above-mentioned end means a minimum distance between this end and each point on the plane. Although in FIG. 3, the origin P of the luminous intensity distribution angle is positioned at the upper end (proximal end) of the scattering member 31 on the central axis C, it may be positioned in an arbitrary place of the lightguide column 30. Furthermore, $\theta_a$ may be arbitrary set in accordance with a required luminous intensity distribution angle. For example, $\theta_a$ may fall within half of a downward light emission angle. In addition, in the embodiment, the axis of symmetry of luminous intensity distribution is set to coincide with the central axis C of the lighting device 100. However, the axis of symmetry of luminous intensity distribution may pass through any point on the light emission surface of the light source 40.

By virtue of this structure, the lighting device 100 can obtain a luminous intensity distribution angle corresponding to the lightguide column 30, and also can have an improved luminous efficacy of radiation. In FIG. 3, distances $r_m$ and $l_m$ have been measured in association with an end of the lens connector 51 as an example.

Figure 5:
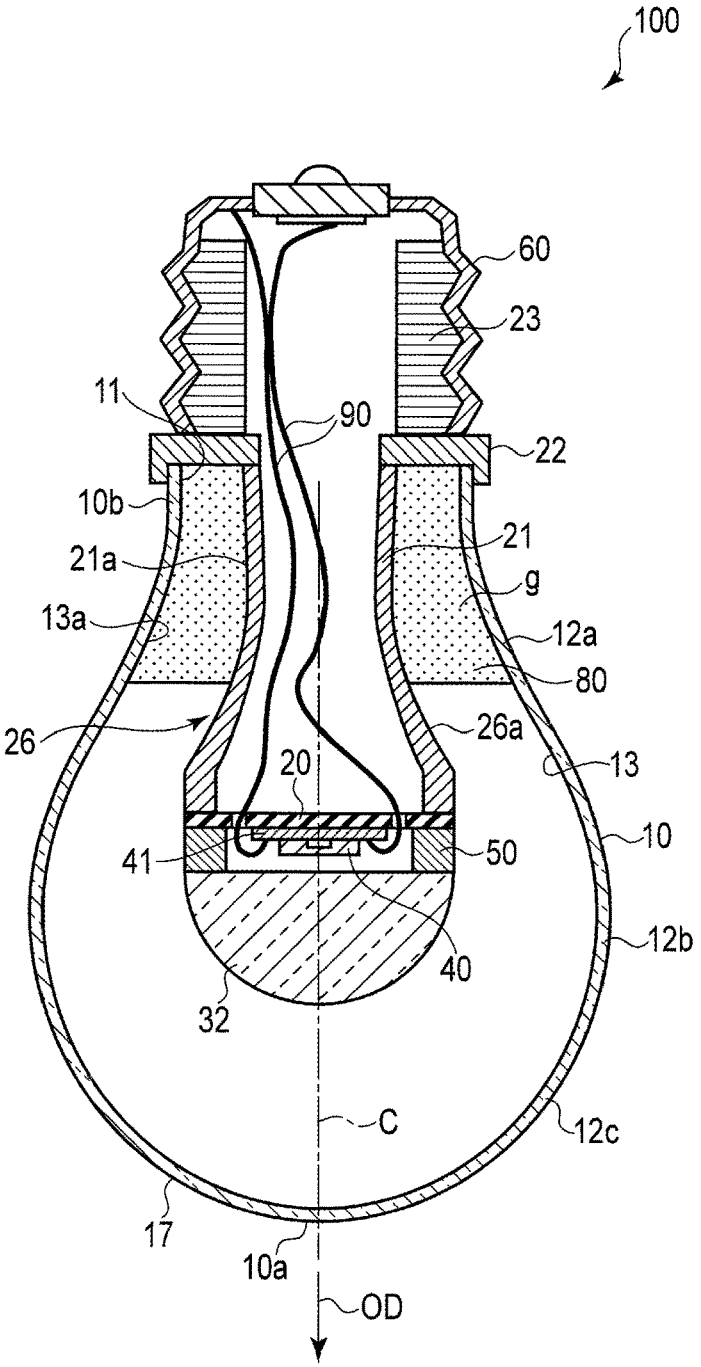
FIG. 5 is a cross-sectional view showing a modification of the lighting device shown in FIG. 1.

The pillar portion 26 may not be parallel to the central axis C, unlike the case of FIG. 3. For instance, the pillar portion 26 may have a surface tilted or curved to the central axis C, as is shown in FIG. 5. By tilting or curving the pillar portion 26, its weight can be reduced.

Next, a desirable contour shape (desirable surface area) of the pillar portion 26 will be described.

Supposing that the surfaces of the pillar portion 26 and the globe 10 are smooth, the surface area of the pillar portion 26 is Ai, the radius of a sphere having substantially the same surface area as the pillar portion 26 is $r_i$, the radius $r_i$ obtained when the junction (light emission element center) of the light source 40 is heated to a heat-resistant temperature is $r_{imin}$, surface area Ai satisfies following formula (6):

$$4\pi r_{imin}^2 \leq A_i \tag{6}$$

Supposing here that the thermal resistance of the entire lighting device 100 is $R_{bulb(ri)}$, the calorific power of the light source 40 is Qi, and a heat-resistant temperature increase in the junction of the light source 40 is $\Delta T_{jmax}$, $r_{imin}$ satisfies following formula (7):

$$\Delta T_{jmax} = R_{bulb}(r_{imin}) Q_l \tag{7}$$

Figure 6:
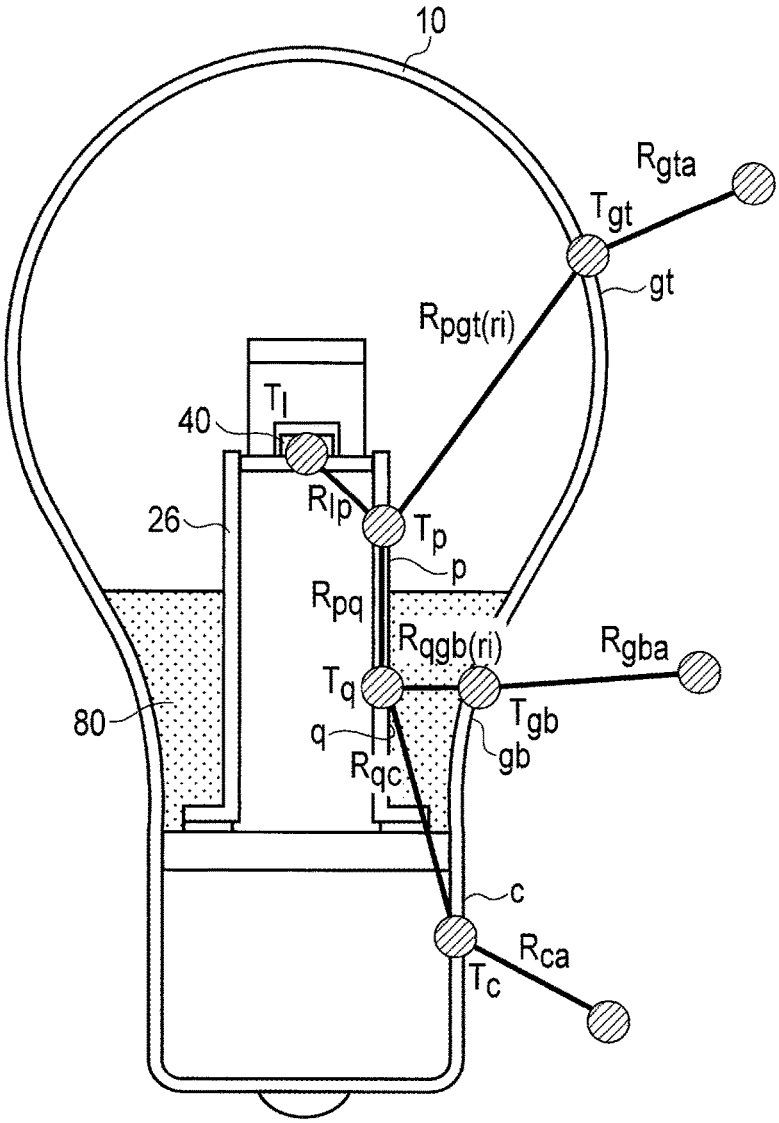
FIG. 6 is a schematic cross-sectional view showing a thermal dissipation path in the lighting device of FIG. 1.
Figure 7:
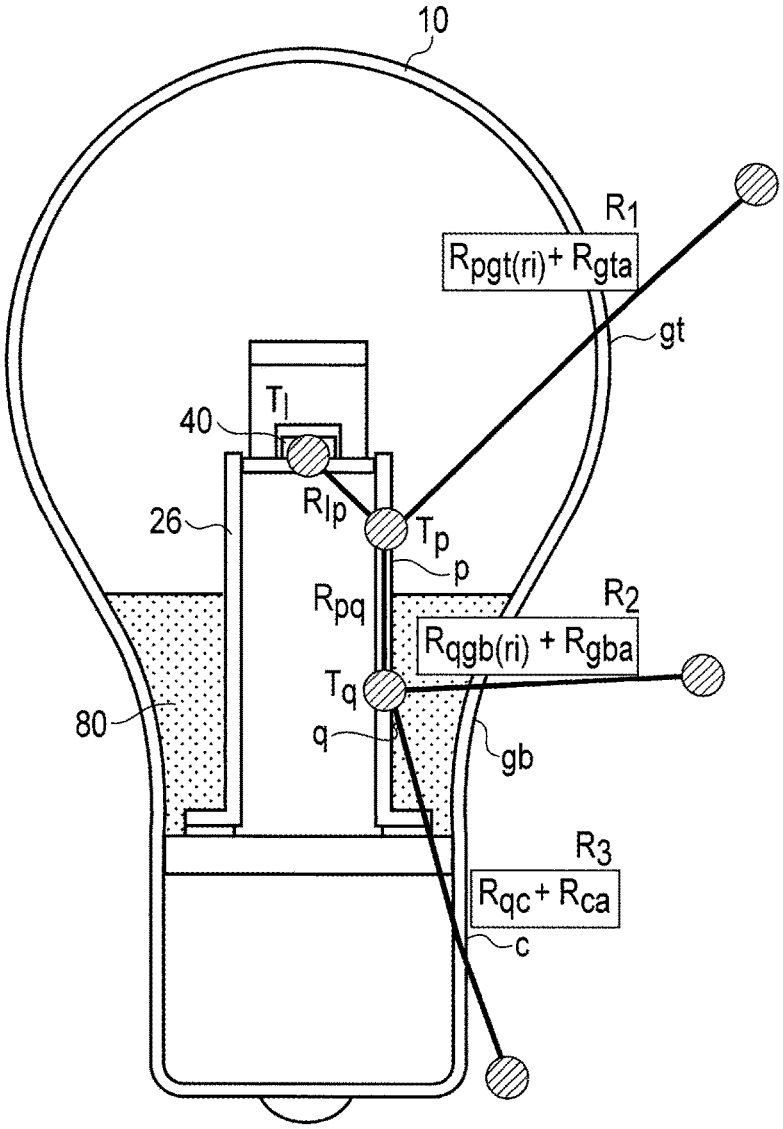
FIG. 7 is a schematic cross-sectional view showing a thermal dissipation path in the lighting device of FIG. 1.

FIG. 6 and FIG. 7 show the thermal dissipation path of the lighting device 100, and FIG. 7 is a view obtained by simplifying FIG. 6. As shown in FIGS. 6 and 7, $R_{bulb(ri)}$ including ri satisfies following formula (8):

$$R_{bulb}(r_i) = R_{lp} + \left\{R_1\left(R_{pq} + \frac{R_2 R_3}{R_2 + R_3}\right)\right\} \Big/ \left\{R_1 + \left(R_{pq} + \frac{R_2 R_3}{R_2 + R_3}\right)\right\} \tag{8}$$

where $R_{lp}$ is a thermal resistance between the junction of the light source 40 and a first surface p (first region) of the pillar portion 26 that is exposed to a gas (air) different from the thermally conductive layer 80, $R_{pq}$ is a thermal resistance between the first surface p of the pillar portion 26 and a second surface q of the pillar portion 26 that is exposed to (contacts) the thermally conductive layer 80, $R_{qc}$ is a thermal resistance between the second surface q of the pillar portion 26 and a surface c (outer surface, outer surface region) of the cap 60 and the globe connector 22 that is exposed to the external air, $R_{pgt(ri)}$ is a thermal resistance between the first surface p of the pillar portion 26 and a first surface gt (first region) of the globe 10 that is exposed to a gas (air) different from the thermally conductive layer 80, $R_{qgb(ri)}$ is a thermal resistance between the second surface q of the pillar portion 26 and a second surface gb (second region) of the globe 10 that is exposed to (contacts) the thermally conductive layer 80, $R_{gta}$ is a thermal resistance between the first surface gt of the globe 10 and an ambient environment, and $R_{ca}$ is a thermal resistance between the surface c of the cap 60 and the globe connector 22 and the ambient environment. In a case where the lighting device 100 does not employ the globe connector 22, the surface c may be formed by the cap 60 only.

Further, $R_1$, $R_2$ and $R_3$ in formula (8) satisfy following formula (9):

$$\left.\begin{aligned} R_1 &= R_{pgt}(r_i) + R_{gta} \\ R_1 &= R_{qgb}(r_i) + R_{gba} \\ R_3 &= R_{qc} + R_{ca} \end{aligned}\right\} \tag{9}$$

A consideration will now be given to thermal resistance $R_{pgt}$ between the first surface p of the pillar portion 26 and the first surface gt of the globe 10. Supposing that a thermal resistance due to convection between the first surface p of the pillar portion 26 and the first surface gt of the globe 10 is $R_{pgtc(ri)}$, and a thermal resistance due to radiation between the first surface p of the pillar portion 26 and the first surface gt of the globe 10 is $R_{pgtr(ri)}$, thermal resistance $R_{pgt(ri)}$ including $r_i$ satisfies following formula (10):

$$R_{pgt}(r_i) = \frac{R_{pgtc}(r_i)R_{pgtr}(r_i)}{R_{pgtc}(r_i) + R_{pgtr}(r_i)} \tag{10}$$

That is, thermal resistance $R_{pgt}$ between the first surface p of the pillar portion 26 and the first surface gt of the globe 10 is formed of thermal resistance $R_{pgtc(ri)}$ by convection, and thermal resistance $R_{pgtr(ri)}$ by radiation.

First, thermal resistance $R_{pgtc(ri)}$ by convection will be considered.

Supposing here that in association with convection between concentric double spherical surfaces, the radius and temperature of the inner spherical surface are $r_i$ and $T_i$, respectively, the radius and temperature of the outer spherical surface are $r_o$ and $T_o$, respectively, the effective thermal conductivity is $k_{eff}$, and the calorific power per unit is q, it is known that the relationship given by following formula (11) is established:

$$q = \frac{4\pi k_{eff}(T_i - T_0)}{(1/r_i) - (1/r_0)} \tag{11}$$

In the embodiment, approximation is performed, assuming that the first surface p of the pillar portion 26 and the first surface gt of the globe 10 are concentric double spherical surfaces. That is, in the embodiment, formula (11) is applied to set, as $T_p$, the mean temperature of the first surface p of the pillar portion 26, to set, as $T_{gt}$, the mean temperature of the first surface gt of the globe 10, to set, as $r_p$, an equivalent radius obtained when the surface p of the pillar portion 26 is approximated as a sphere, and to set, as $r_{gt}$, an equivalent radius obtained when the surface gt of the globe 10 is approximated as a sphere. In this case, $R_{pgtc(ri)}$ including $r_i$ satisfies following formula (12):

$$R_{pgtc}(r_i) = \frac{1/r_p - 1/r_{gt}}{4\pi k_{eff}} \tag{12}$$

Supposing here that the thermal conductivity of gas is k, the Prandtl number of the gas is Pr, and the Rayleigh number of the gas is $Ra_s$, the effective thermal conductivity $k_{eff}$ can be given by following formula (13):

$$k_{eff} = 0.74k\left(\frac{Pr}{0.861 + Pr}\right)^{1/4} Ra_s^{1/4} \tag{13}$$

Furthermore, supposing that the gravitational acceleration is g, the volume modulus of gas is β, the dynamic coefficient of viscosity is ν, and the thermometric conductivity of gas is α, the Rayleigh number $Ra_s$ can be given by following formula (14):

$$Ra_s = \frac{g\beta(T_p - T_{gt})L_s^3}{\nu\alpha} \tag{14}$$

In addition, representative length $L_s$ can be acquired from following formula (15):

$$L_s = \frac{(1/r_p - 1/r_{gt})^{4/3}}{2^{1/3}(r_p^{-7/5} + r_{gt}^{-7/5})^{5/3}} \tag{15}$$

Next, thermal resistance $R_{pgtr(ri)}$ due to the above-mentioned radiation will be considered.

Supposing in association with radiation between a convex surface and a surface surrounding the convex surface in a double planar system that the area, temperature and mean radiation coefficient of the convex surface are $A_1$, $T_1$ and $\varepsilon_1$, respectively, the area, temperature and mean radiation coefficient of the surrounding surface are $A_2$, $T_2$ and $\varepsilon_2$, respectively, the Stefan=Boltzmann's constant is σ, and the heat flow is Q, it is known that the relationship given by following formula (16) is established:

$$Q = \frac{\sigma A_1(T_1^4 - T_2^4)}{\frac{1}{\varepsilon_1} + \frac{A_1}{A_2}\left(\frac{1}{\varepsilon_2} - 1\right)} \tag{16}$$

In the embodiment, approximation is performed, regarding the first surface p of the pillar portion 26 and the first surface gt of the globe 10 as the above-mentioned convex surface and the surrounding surface in the double planar system, respectively. That is, in the embodiment, formula (16) is applied to set, as $\varepsilon_p$, the mean radiation coefficient of the surface p of the pillar portion 26, and to set, as $\varepsilon_{gt}$, the mean radiation coefficient of the surface gt of the globe 10. In this case, $R_{pgtr(ri)}$ including $r_i$ satisfies following formula (17):

$$R_{pgtr}(r_i) = \frac{\left\{\frac{1}{\varepsilon_p} + \frac{r_p^2}{r_{gt}^2}\left(\frac{1}{\varepsilon_{gt}} - 1\right)\right\}}{4\pi r_p^2\sigma(T_p + T_{gt})(T_p^2 + T_{gt}^2)} \tag{17}$$

Next, thermal resistance $R_{qgb}$ between the second surface q of the pillar portion 26 and the second surface gb of the globe 10 will be considered. Supposing that a thermal resistance due to thermal conduction between the second surface q of the pillar portion 26 and the second surface gb of the globe 10 is $R_{qgbc(ri)}$, and a thermal resistance due to radiation between the second surface q of the pillar portion 26 and the second surface gb of the globe 10 is $R_{qgbr(ri)}$, thermal resistance $R_{qgb(ri)}$ including $r_i$ satisfies following formula (18):

$$R_{qgb}(r_i) = \frac{R_{qgbc}(r_i)R_{qgbr}(r_i)}{R_{qgbc}(r_i) + R_{qgbr}(r_i)} \tag{18}$$

That is, thermal resistance $R_{qgb}$ between the second surface q of the pillar portion 26 and the second surface gb of the globe 10 is formed of thermal resistance $R_{qgbc(ri)}$ due to thermal conduction, and thermal resistance $R_{qgbr(ri)}$ due to radiation.

Thermal resistance $R_{qgbc(ri)}$ due to thermal conduction will be considered first.

Supposing here in association with convection between concentric double cylinders, the radius of the inner cylinder is $R_1$, the radius of the outer cylinder is $R_2$, the length of the cylinders is L, the thermal conductivity is k, and the thermal resistance is R, it is known that the relationship given by following formula (19) is established:

$$R = \frac{\ln(R_2/R_1)}{2\pi Lk} \tag{19}$$

In the embodiment, approximation is performed, assuming that the second surface q of the pillar portion 26 and the second surface gb of the globe 10 are concentric double cylinders. That is, in the embodiment, formula (19) is applied to set, as $T_q$, the mean temperature of the second surface q of the pillar portion 26, to set, as $T_{gb}$, the mean temperature of the second surface gb of the globe 10, to set, as $r_q$, an equivalent radius obtained when the second surface q of the pillar portion 26 is approximated as a cylinder, to set, as $r_{gb}$, an equivalent radius obtained when the second surface gb of the globe 10 is approximated as a cylinder, and to set, as lq, the length of a portion of the pillar portion 26 that is in contact with the thermally conductive layer 80, and to set, as k, the thermal conductivity of the thermally conductive layer 80. In this case, $R_{qgbc(ri)}$ including $r_i$ satisfies following formula (20):

$$R_{qgbr}(r_i) = \frac{\ln(r_{gb}/r_q)}{2\pi d_q k} \tag{20}$$

Next, thermal resistance $R_{qgbr(ri)}$ due to the above-mentioned radiation will be considered.

Supposing here in association with radiation between parallel double planes, the temperature and mean radiation coefficient of the inner plane are $T_1$ and $\varepsilon_1$, respectively, the temperature and mean radiation coefficient of the outer plane are $T_2$ and $\varepsilon_2$, respectively, the Stefan=Boltzmann's constant is $\sigma$, and the heat flow per unit area is q, it is known that the relationship given by following formula (21) is established:

$$q = \frac{\sigma(T_1^4 - T_2^4)}{\frac{1}{\varepsilon_1} + \frac{1}{\varepsilon_2} - 1} \tag{21}$$

In the embodiment, approximation is performed, assuming that the second surface q of the pillar portion 26 and the second surface gb of the globe 10 are parallel double planes in the double plane system. That is, in the embodiment, when formula (21) is applied to set, as $\varepsilon_q$, the mean radiation coefficient of the second surface q of the pillar 21, and to set, as $\varepsilon_{gb}$, the mean radiation coefficient of the second surface gb of the globe 10, $R_{qgbr(ri)}$ including $r_i$ satisfies following formula (22):

$$R_{qgbr}(r_i) = \frac{\left\{\frac{1}{\varepsilon_p} + \frac{1}{\varepsilon_{gb}} - 1\right\}}{\pi(r_q + r_{gb})l_q\sigma(T_p + T_{gb})(T_p^2 + T_{gb}^2)} \tag{22}$$

In the embodiment, considering the thermal resistance of each thermal dissipation path as described above, surface area Ai of the pillar portion 26 is set to satisfy above formula (6).

In addition, surface area Ai of the pillar portion 26 may be set to satisfy following formula (23):

$$4\pi r_{imin}^2 = A_i \tag{23}$$

That is, in the structure that satisfies formula (23), the pillar portion 26 is designed small up to a limit set in consideration of the heat-resistant temperature of the junction of the light source 40, and is made inconspicuous from the outside. That is, this structure further improves the appearance of the lighting device 100.

Although in the embodiment, only the light source 40 is assumed as a heating element, the heat of the globe 10 and/or the lightguide column 30 due to light absorption, and/or the heat of elements, such as the power supply circuit, in the pillar 21 may also be considered.

(Explanation of Function)

Where the cap 60 of the lighting device 100 is fitted in a socket provided at the ceiling of a room or in a lighting tool, if electrical power is supplied to the socket by, for example, an indoor power supply, a constant current is supplied to the light source 40 through a power supply circuit incorporated in the cap 60, the cap connector 23 or the supports 21, or through an external power supply. As a result, the light source 40 emits light.

The lightguide column 30 guides, to the scattering member 31, the light emitted from the light source 40. The light having reached the scattering member 31 is diffused by the same and externally emitted. Thus, the luminous flux finally emitted from the lightguide column 30 has a wide distribution because of the two effects of light guiding and the light diffusion of the scattering member 31.

The light source 40 produces heat along with radiation. This heat is transmitted from the light source 40 to the substrate 41, and then to the base 20 and the substrate connector 50 through the interior of the substrate 41. The heat transmitted to the base 20 is transmitted therethrough to the pillar portion 26 comprising the pillar 21 and the lens connector 51. A part of the heat transmitted to the pillar portion 26 is transmitted, to the globe 10 mainly by thermal conduction, from a portion of the lateral surface **26*a* of the pillar portion 26 that contacts the thermally conductive layer 80. Another part of the heat is transmitted, to the globe 10 by convection and radiation, from a portion of the pillar portion 26 that is exposed to a fluid in the globe 10. Yet another part of the heat is transmitted by thermal conduction to the globe connector 22 and the cap connector 23. A part of the heat transmitted to the base connector 50 is transmitted to the lightguide column 30, and another part of this light is transmitted to the lens connector 51. The heat transmitted to the lightguide column 30 is transmitted to the globe 10 by convection and radiation from the surface of the column. The heat transmitted to the globe 10** is externally emitted by convection and radiation.

A part of the heat transmitted to the globe connector 22 is transmitted to the globe 10, and another part of this heat is externally emitted by convection and radiation. Further, the heat transmitted to the cap connector 23 is transmitted to the cap 60. The heat transmitted to the cap 60 is externally emitted through a socket (not shown).

As described above, a grease, a sheet, a tape or a screw, which is excellent in thermal conduction, is used to thermally connect the substrate 41 to the bases 20, the base 20 to the pillar 21, the base 20 to the substrate connectors 50, the pillar 21 to the globe connectors 22, the globe connector 22 to the cap connectors 23, the cap connector 23 to the cap 60, the substrate connector 50 to the lens connector 51, and the lens connector 51 to the pillar 21. As a result, heat can be efficiently transmitted therebetween.

In the embodiment, the thermally conductive layer 80 is provided between the inner surface 13 of the globe 10, and the lateral surface 26*a* of the pillar portion 26. This structure enables the heat transmitted to the pillar portion 26 to be effectively dissipated to the globe 10 by the thermal conduction of the thermally conductive layer 80, which improves the thermal dissipation performance of the lighting device 100. By virtue of this, an increase in the luminous intensity distribution angle and the degree of transparency can be realized by, for example, increasing the outer surface area of the globe 10, and the total luminous flux can be increased by incorporating a high-output LED.

In the embodiment, the globe 10 has the enlarged portion 12*a* which extends along the optical axis OD of the light source 40 and whose outer circumferential length increases from the end portion 10*b* toward the apex portion 10*a*. The thermally conductive layer 80 is located between the inner surface 13*a* of the enlarged portion 12*a* and the lateral surface 26*a* of the pillar portion 26. In this structure, the thermal dissipation is enhanced using the enlarged portion 12*a* of the globe 10 that has a retrofit appearance.

In the embodiment, the pillar 21 extends along the optical axis OD of the light source 40. The thermally conductive layer 80 extends over substantially half or more of the length of the pillar 21 (or substantially half or more of the length of the pillar portion 26). Since in this structure, the thermally conductive layer 80 extends over a relatively long length, the thermal dissipation performance of the lighting device 100 can be further improved.

In the embodiment, various sizes are set to satisfy above-mentioned formula (1), and the layer of gas between the inner surface 13 of the globe 10 and the lateral surface 26*a* of the pillar portion 26 functions as the thermally conductive layer 80. By the thermal conduction of the thermally conductive layer 80 formed of gas, the heat of the pillar portion 26 can be effectively transmitted to the globe 10, and then diffused and released externally through the globe 10.

In the embodiment, thickness d of the thermally conductive layer 80 is set greater than the wavelength λ of the light emitted by the light source 40. This enables the reflection coefficient of the light transmitted through the globe 10 to be close to 100%, enables most of the light transmitted through the globe 10 to be extracted as illumination light from the outer surface, and enables loss of light due to absorption of light by the pillar portion 26 to be reduced. As a result, the pillar portion 26 can be made inconspicuous from the outside of the lighting device 100, whereby the appearance of the lighting device 100 is improved.

The surface of the pillar 21 may be coated with a radiation layer (not shown). The radiation layer is formed of alumite resulting from a surface treatment, or of painting. If a material having a low visible-light absorbency, such as white paint, is used for the radiation layer, loss of light on the surface of the pillar portion 26 can be reduced. The surface of the pillar 21 may be made glossy by polishing, coating, metal deposition, etc. In this case, radiation is suppressed, but loss of light on the surface of the globe connector 22 can be reduced.

In the embodiment, a thermal connection portion 15 (a projection or a recess) may be provided at an end of the globe connector 22 for increasing the area of connection between the globe connector 22 and the globe 10. The globe connector 22 and the globe 10 are secured to each other using an adhesive having a high thermal resistance, or are formed in the shape of screws and screwed to each other. Alternatively, the globe 10 may be directly connected to the cap 60 by direct screwing, adhesion, etc., without using the globe connector 22. When the globe 10 is directly connected to the cap 60, the cap connector 23 is connected to the inside of the globe 10 by screwing, adhesion, etc.

In order to promote thermal dissipation from the globe connector 22 to the environment, a radiation layer may be provided on a surface of the globe connector 22 that is exposed to the air. The radiation layer is formed, for example, of alumite resulting from surface treatment, or by painting. If a material having a low visible-light absorbency, such as white paint, is used as the material of the radiation layer, loss of light on the surface of the globe connector 22 can be reduced.

On the other hand, in order not to reduce the luminous intensity distribution angle of the lighting device 100, the pillar 21 and the lens connector 51 may be located within a range defined by the origin P of the scattering member 31 of the lightguide column 30, and the lines 70 that extend with the luminous intensity distribution angle θa formed therebetween, as is shown in FIG. 3.

In the embodiment, the globe 10 is constructed to cover substantially the entire surface of the lighting device 100 except for the cap 60. However, the globe 10 may be constructed to cover only part of the device 100, with the other part covered by a metal casing. In this case, heat can be dissipated through the surface of the metal casing, as well as the surface of the globe 10.

Moreover, the heat discharged from the lightguide column 30 and the globe connector 22 warms air in the globe 10. As indicated by a streamline 71 in FIG. 4, the warmed air flows because of convection in a direction opposite to the direction of gravity along the surface of the pillar portion 26. The air having reached the upper end of the pillar portion 26 is gradually cooled by the inner surface of the globe 10 and flows in the direction of gravity. By this flow of air, heat transmission from the pillar portion 26 to the globe 10 is promoted to thereby further cool the lighting device 100.

When the air flows upward along the periphery of the pillar portion 26, the temperature of the air gradually increases. That is, in the vicinity of the surface of the pillar portion 26, the temperature of the air is lowest near the lower end of the pillar portion 26, and increases as the air approaches the upper end of the same. By locating the lightguide column 30 and the light source 40 at the lower end of the pillar portion 26 as in the embodiment, the light source 40 can be efficiently cooled by air of a lower temperature.

By forming a cavity in the pillar 21, forming an opening only in an end of the pillar 21 close to the cap 60, or openings in opposite ends of the pillar 21 including an end close to the light source 40, and forming the hole 20*d* in the lateral surface of the substantially cylindrical pillar 21, the wires 90 electrically connected to the light source 40 can be extended to the cap 60, thereby improving the appearance of the lighting device and reducing the possibility of unintentionally interrupting light by looseness of the wires 90. The same can be said of the through holes 20*c* formed in the base 20 for passing the wires 90 therethrough.

The substrate connector 50 and the lens connector 51 are engaged with the base 20 or the pillar 21, using, for example, a screw. By providing a recess or a projection at the substrate connector 50 or the lens connector 51 so that it is engaged with a projection or a recess at the end face of the lightguide column 30, the lightguide column 30 can be secured between the substrate connector 50 and the lens connector 51. Further, a gap can be provided between the lightguide column 30 and the light source 40 as shown in FIG. 2.

By providing the gap between the lightguide column 30 and the light source 40, influence due to the difference in thermal expansion coefficient between the lightguide column 30 and the light source 40 can be avoided. This structure also enables the lightguide column 30 to be kept away from the light source 40 that assumes a high-temperature state. That is, the temperature of the lightguide column 30 can be kept lower than that of the light source 40. By virtue of this structure, even if the lightguide column 30 is formed of a material (e.g., acryl) having a heat-resistant temperature lower than that of the light source 40, higher power can be supplied to the light source 40 to thereby obtain higher total luminous flux.

The wires 90 may be directly connected to the cap 60, or one of the wires 90 may be connected to the base 20. If one of the wires 90 is connected to the base 20, the amount of the wires 90 can be reduced, and the appearance can be improved. In this case, it is necessary to employ means for electrically connecting the pillar 21 to the substrate 41, such as making, conductive, all or a part of the base 20, the pillar 21, the globe connector 22 and the cap connector 23. Thus, the cap connector 23 may be electrically connected to the light source 40 through all or a part of the glove connector 22, the pillar 21, the base 20 and the substrate 41.

In the embodiment, although the base 20, the pillar 21, the globe connector 22, the substrate connector 50, the lens connector 51 and the cap connector 23 are different component parts, a part or all of them may be formed integral as one body. In this case, it becomes difficult to produce the component parts. However, the resultant product is free from the thermal resistances of junctions of the component parts, thereby further improving the thermal dissipation performance.

In the embodiment, the cap connector 23 is electrically conductive. However, the cap connector 23 may be formed of a material having a high electrical insulation property (such as Polybutylene terephthalate [PBT], polycarbonate or Polyetheretherketone [PEEK]), or may be coated with a layer of a high electrical insulation property. In this case, an electrical failure can be avoided when an electrical circuit (not shown) is provided in the cap connector 23. Both the positive and negative electrodes of the wires 90 are connected to the electrical circuit. If there is no electrical circuit, the wires 90 are directly connected to the cap 60.

Although in the embodiment, it is assumed that the power supply circuit is located externally with respect to the lighting device 100, it may be contained in the cap 60, the cap connector 23 or the pillar 21. Alternatively, a case may be provided in the pillar 21 to contain the power supply circuit. This case may be formed of a material having a high electrical insulation property (such as Polybutylene terephthalate [PBT], polycarbonate or Polyetheretherketone [PEEK]), or may be coated with a layer of a high electrical insulation property. In this case, an electrical failure can be avoided when an electrical circuit (not shown) is provided in the pillar 21.

In the lighting device 100 of the embodiment, since the pillar 21 is provided in the globe 10, thermal dissipation can be performed efficiently. This further improves the thermal dissipation performance of the lighting device 100.

Second to sixth embodiments will now be described. In these embodiments, structures having the same or similar functions as those of the first embodiment are denoted by the same reference numbers, and will not be described. Further, the structures other than those described below are the same as those of the first embodiment.

Second Embodiment

Figure 8:
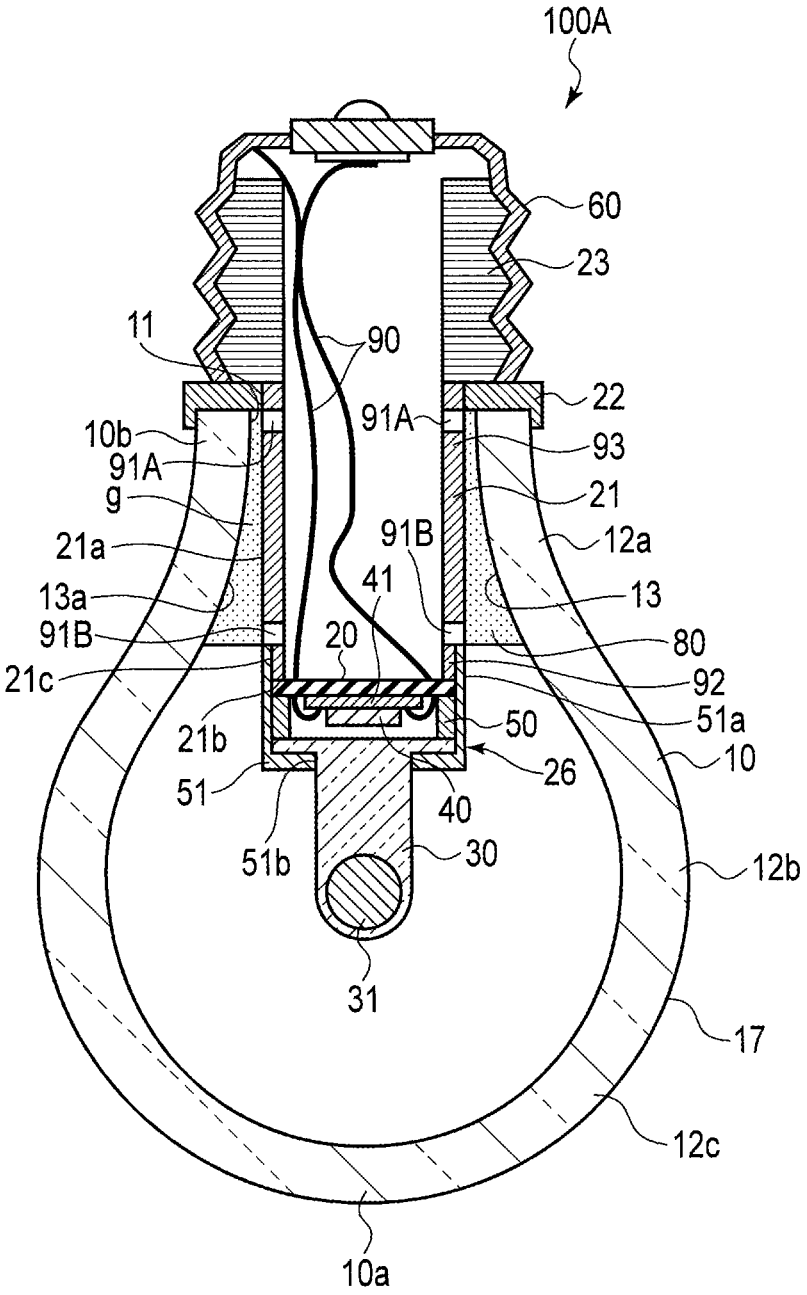
FIG. 8 is a cross-sectional view showing a lighting device according to a second embodiment.
Figure 9:
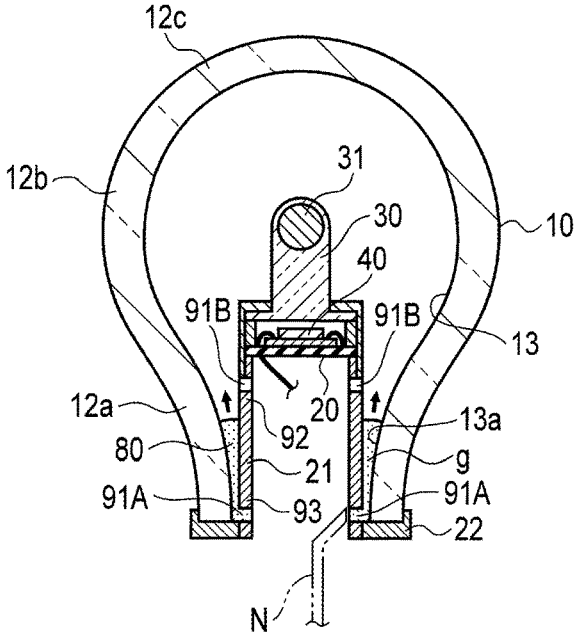
FIG. 9 is a cross-sectional view showing a method example of injecting a synthetic resin into the lighting device of FIG. 8.

FIG. 8 shows a lighting device 100A according to a second embodiment. FIG. 9 shows a method of injecting a synthetic resin into the lighting device 100A of FIG. 8.

The lighting device 100A is obtained by modifying the lighting device 100 shown in FIGS. 1 to 7 to form the thermally conductive layer 80 of, instead of gas, a material (filler), such as an adhesive, which normally has fluidity and is solidified depending upon, for example, temperature or drying. The filler does not necessarily need to be solidified, but it is sufficient if the viscosity of the filler is dominant in the gap g between the globe 10 and the pillar portion 26, compared to the fluidity (i.e., the filler does not substantially flow out of the gap g).

The thermally conductive layer 80 of the second embodiment is formed of a synthetic resin injected and solidified between, for example, the inner surface 13 of the globe 10 and the lateral surface 26*a* of the pillar portion 26. In this case, formula (1) mentioned above does not need to be satisfied. The synthetic resin is injected along, for example, the inner surface 13 of the globe 10.

The thermally conductive layer 80 is formed of, for example, a transparent synthetic resin or adhesive that permits light to pass therethrough. The synthetic resin as the material of the thermally conductive layer 80 may contain particles that scatter (diffuse) light. When such diffusion particles are contained, the pillar portion 26 becomes inconspicuous from the outside of the lighting device 100A, which means that the appearance of the device will improve. The thermally conductive layer 80 may contain a thermally conductive filler to further increase its thermal conduction.

In the second embodiment, the pillar 21 has a cavity formed in the center of the body, and inlet holes 91A and outlet holes 91B formed in the lateral surface 21*a*. The inlet and output holes 91A and 91B cause the cavity of the pillar 21 to communicate with the gap g between the inner surface 13 of the globe 10 and the lateral surface 26*a* of the pillar portion 26. Although one inlet hole 91A and one outlet hole 91B may be formed, it is preferable to form a plurality of inlet holes and a plurality of outlet holes when, for example, a synthetic resin having a high viscosity is injected.

The pillar 21 has a first end 92 supporting the base 20, and a second end 93 located opposite to the first end 92. The second end 93 faces the inner surface of the opening 11 of the globe 10. In the second embodiment, the inlet holes 91A are formed in the second end 93 of the pillar 21, and the outlet holes 91B are formed in the first end 92 of the pillar 21.

In the above-described structure, a synthetic resin can be relatively easily injected from the interior of the pillar 21 into the gap g between the inner surface 13 of the globe 10 and the lateral surface 26*a* of the pillar portion 26 by, for example, inserting a nozzle N for injecting the synthetic resin into the cavity of the pillar 21 and aligning the same with the inlet hole 91A, as is shown in FIG. 9.

In accordance with the injection of the synthetic resin, a part of the gas in the globe 10 is externally discharged with respect to the device through the outlet holes 91B and the interior of the pillar 21. Further, the injected synthetic resin fills the gap g between the globe 10 and the pillar 21, and a part of the resin, for example, is returned through the outlet holes 91B to the inside of the pillar 21. Thus, excessive injection of the synthetic resin is suppressed, whereby the height of the thermally conductive layer 80 is stably settled.

After the synthetic resin is injected into the gap g between the globe 10 and the pillar portion 26, it may be solidified by, for example, heat or ultraviolet rays. Furthermore, the synthetic resin may be solidified by mixing two kinds of liquid. The outlets 91B are not always necessary. In accordance with the injection of the synthetic resin, the gas in the globe 10 may be compressed therein.

In the second embodiment, the synthetic resin is injected through the inlet holes 91A. However, another material (for example, glass or a metal) forming the thermally conductive layer 80 may be injected through the inlet holes 91. The outlet holes 91B may let the gas in the globe 10 to escape when glass or a metal is injected through the inlet holes 91A.

The above-described lighting device 100A can exhibit an improved thermal dissipation performance as in the first embodiment. Furthermore, in the second embodiment, the thermally conductive layer 80 is formed of a synthetic resin injected in between the inner surface 13 of the globe 10 and the lateral surface 26*a* of the pillar portion 26. This structure can effectively transmit heat from the pillar portion 26 to the globe 10.

In the second embodiment, the pillar portion 26 includes the inlet holes 91A for guiding the synthetic resin from the interior of the pillar portion 26 into the gap between the inner surface 13 of the globe 10 and the lateral surface 26*a* of the pillar portion 26. This structure enables the synthetic resin to be relatively easily injected into the gap g between the globe 10 and the pillar portion 26.

In the second embodiment, the pillar portion 26 includes the outlet holes 91B for letting the gas in the globe 10 to escape externally with respect to the device through the interior of the pillar portion 26 when the synthetic resin is injected. This structure can easily drive the gas from the gap g between the globe 10 and the pillar portion 26, thereby enabling the synthetic resin to be further easily filled.

Figure 10:
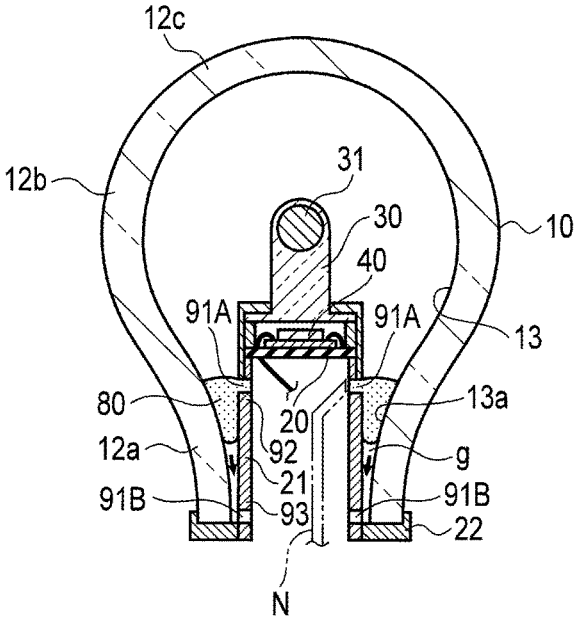
FIG. 10 is a cross-sectional view showing a first modification of the lighting device shown in FIG. 8.

FIG. 10 shows a lighting device 100A according to a first modification of the second embodiment. In the first modification, the inlet holes 91A and the outlet holes 91B are positioned in an opposite way to the case of FIG. 9. In the first modification, the inlet holes 91A are formed in the first end 92 of the pillar 21, and the outlet holes 91B are formed in the second end 93 of the pillar 21. This structure also enables the synthetic resin to be relatively easily injected from the interior of the pillar portion 26 into the gap g between the globe 10 and the pillar portion 26.

Figure 11:
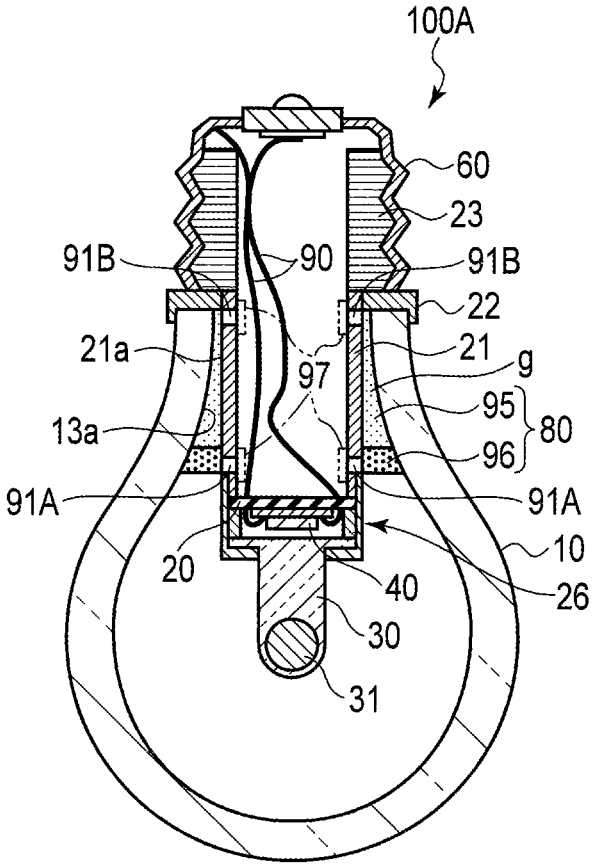
FIG. 11 is a cross-sectional view showing a second modification of the lighting device shown in FIG. 8.

FIG. 11 shows a lighting device 100A according to a second modification of the second embodiment. The second modification is an example where, for example, after a first synthetic resin 95 of high mobility is injected, a second synthetic resin 96 of lower mobility than the first synthetic resin 95 is injected and is used as a lid. The first and second synthetic resins 95 and 96 may not be solidified. Instead of this structure, lids 97 may be attached to the inlet and outlet holes 91A and 91B.

Figure 12:
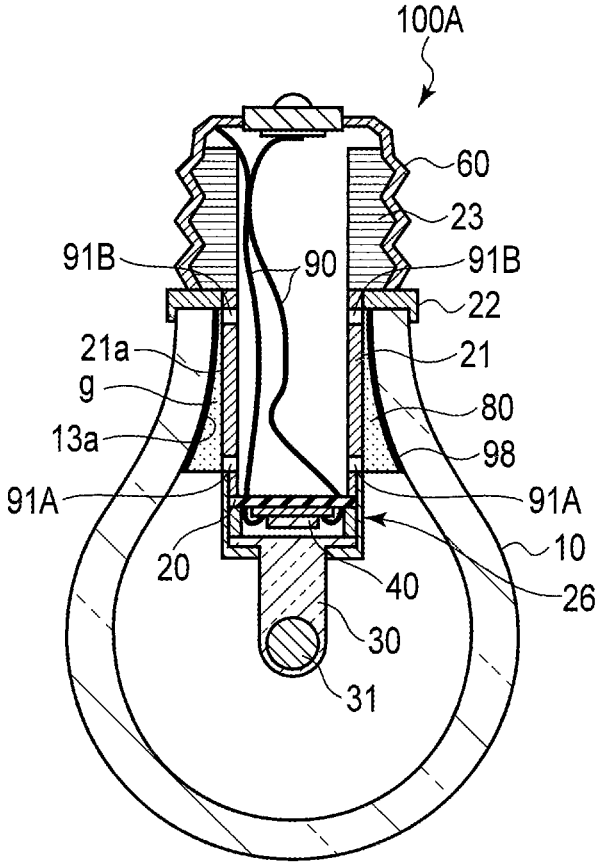
FIG. 12 is a cross-sectional view showing a third modification of the lighting device shown in FIG. 8.

FIG. 12 shows a lighting device 100A according to a third modification of the second embodiment. In the third modification, a diffusion sheet 98 having a light diffusion property is provided between the inner surface 13 of the globe 10 and the thermally conductive layer 80 (formed of, for example, a synthetic resin). The diffusion sheet 98 is attached on the inner surface 13 of the globe 10 or the lateral surface 26*a* of the pillar portion 26. This structure can reduce loss of light due to light absorption by the pillar portion 26, and makes the pillar portion 26 inconspicuous from the outside of the lighting device 100, thereby improving the appearance of the device.

If the synthetic resin or adhesive sealed as the thermally conductive layer 80 has the same color as the globe 10 (or is transparent or is of a frost color), it becomes more inconspicuous, thereby further improving the appearance of the lighting device 100A. Similarly, if the synthetic resin or adhesive has the same color as the pillar 21 or the lens connector 51, it becomes more inconspicuous, thereby further improving the appearance of the lighting device 100A.

The inlet holes 91A also function as vents when they are not filled with, for example, the adhesive. If there exist a plurality of holes opening vertically downward, air flows into the pillar 21 through these holes and flows out of the pillar 21 through the upper holes, and hence the inner wall of the pillar 21 also functions as a thermal dissipation area, thereby further reducing the thermal resistance. When the holes are used as vents, three or more holes opening vertically downward may be provided.

Figure 13:
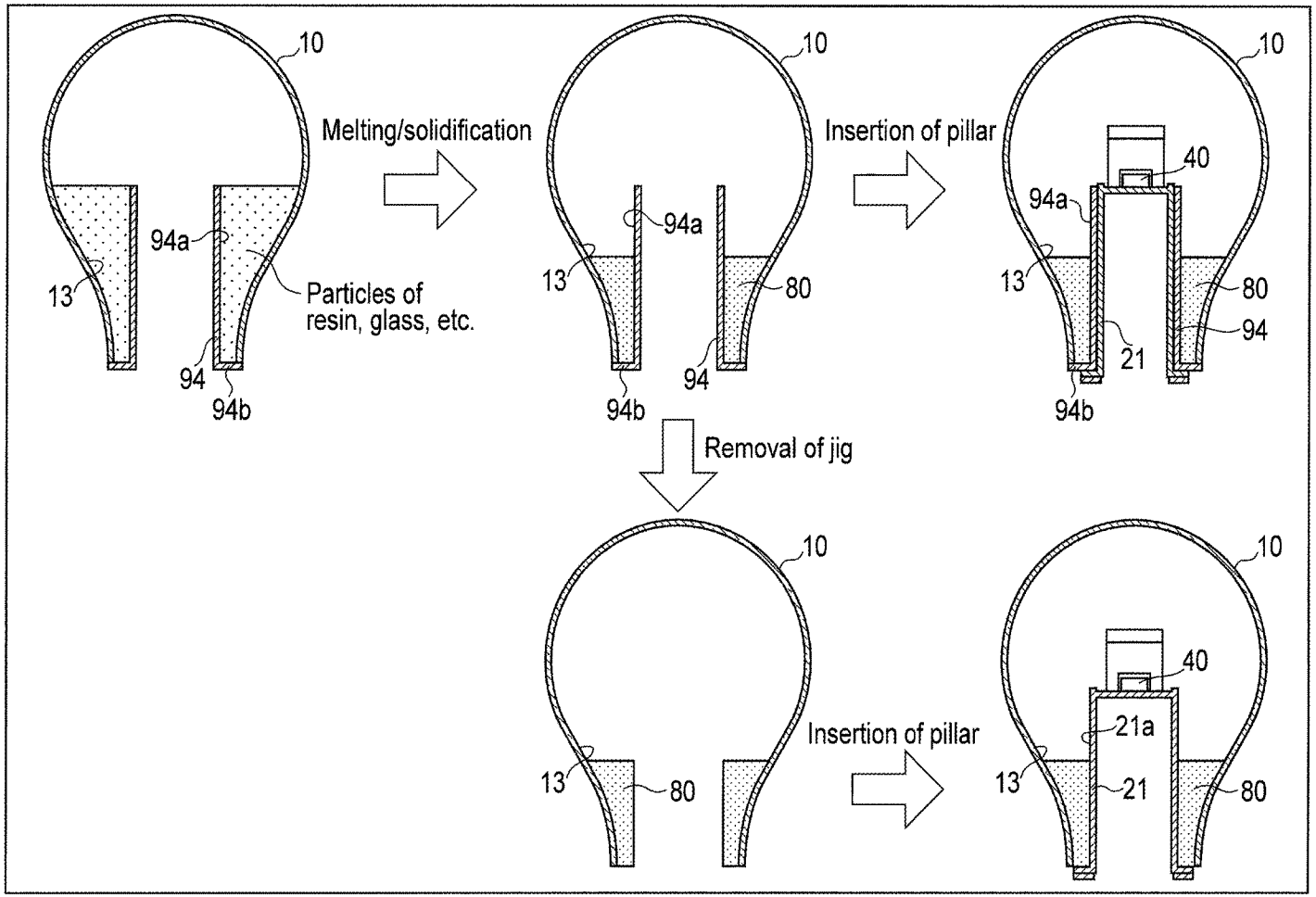
FIG. 13 is a view for explaining a method example of forming a thermally conductive layer shown in FIG. 8.

As shown in FIG. 13, to solidify the synthetic resin or adhesive, a jig 94 that has the same shape as the pillar 21 or has a diameter not less than the pillar 21 may be used instead of the pillar 21. In FIG. 13, the cap 60 is located in a lower position, and the globe 10 is located in an upper position. The jig 94 has a lid 94*b* that closes, from below, the gap between the inner surface 13 of the globe 10 and the lateral portion 94*a* of the jig 94 when the opening 11 of the globe 10 is directed downward. Therefore, when a material for providing the thermally conductive layer 80 is inserted in a non-solidified state between the inner surface 13 of the globe 10 and the lateral portion 94*a* of the jig 94, it is held by the lid 94.

In this case, a resin, an adhesive or glass can be inserted, which has a melting temperature exceeding the heat-resistant temperature of the LED and has been heated to a temperature less than the melting temperature of the globe 10. Further, the distal end of the jig 94 (in this position, the light source 40 is located on the pillar 21) can also be opened like the proximal end of the jig on the cap 60 side, which further facilitates the insertion. In addition, it is necessary, for example, to form the globe 10 of heat-resistant glass and form the insert of float glass. That is, it is necessary to use, as the insert, glass having a lower melting temperature than the glass of the globe 10.

Moreover, since it is not necessary to form, for example, the inlet holes 91A in the pillar 21, the appearance of the device is improved and the manufacturing cost is reduced. Also, an arbitrary gap can be provided between the pillar 21 and the thermally conductive layer 80. If a gap greater than the wavelength of light is formed, absorption of light by surface of the pillar 21 can also be avoided. Further, if the jig 94 is subjected to a surface treatment so as not to be brought into tight contact with the insert, it can be easily detached after the solidification of the insert. Similarly, if the inner surface of the globe 10 is subjected to a surface treatment so as not to be brought into tight contact with the insert, load on the globe 10 applied after the solidification of the insert can be reduced to thereby prevent the globe 10 from being damaged.

The lighting device 100A may be formed without detaching the jig 94, i.e., by inserting the pillar 21 into the jig 94. In this case, the jig 94 remains in the lighting device 100A as a cylinder portion (outer cylinder portion) provided on the periphery of the pillar 21 (pillar portion 26). The thermally conductive layer 80 is interposed between the inner surface 13 of the globe 10 and the lateral surface 94*a* of the jig 94.

The jig 94 is allowed to be fixed to the insert (thermally conductive layer 80). Further, it is not necessary to insert a synthetic resin, a metal or glass in a molten state. These materials may be inserted in a solidified state. Alternatively, a solid material may be inserted between the jig 94 and the inner surface of the globe 10, thereby placing the globe 10, the jig 94 and the material in a furnace, melting the material, and then solidifying the material.

When a solid material is inserted, it is desirable to set the diameter and length of the jig 94 so as to enable the shape of the material after melting and solidifying to follow the shape of the pillar 21. For example, when a powder material is molten and solidified, the volume of the material during melting is less than the envelope volume of the entire power material because gaps between the powder particles are lost during the melting. In view of this, it is desirable to make the jig 94 longer than the pillar 21 (or pillar portion 26). By making the shape of the jig 94 follow the shape of the globe 10, the difference in curvature between the inner surface 13 and the outer surface 17 of the globe 10 (namely, the difference in curvature between the content of the globe 10 and the outer surface 17) can be controlled to thereby improve the appearance.

Figure 14:
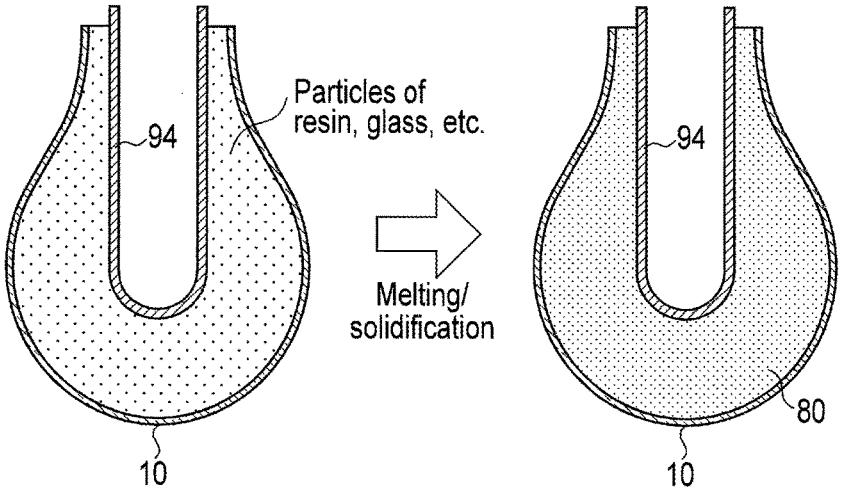
FIG. 14 is a view for explaining another method example of forming the thermally conductive layer shown in FIG. 8.

A flexible material (gel) having a shape that meets the inner surface 13 of the globe 10 and the lateral surface 26*a* of the pillar portion 26 may be inserted into the globe 10 before inserting the pillar portion 26. In this case, an injection (insertion) work and a standby time until the hardening are not required, which improves production performance. In addition, a material for forming the thermally conductive layer 80 may be injected (inserted), with the cap 60 kept in an upper position and the globe 10 kept in a lower position, as is shown in FIG. 14. In this case, the material can be injected up to the apex (bottom) of the globe 10, whereby the thermal resistance of the interior of the globe 10 is reduced as a whole.

Third Embodiment

Figure 15:
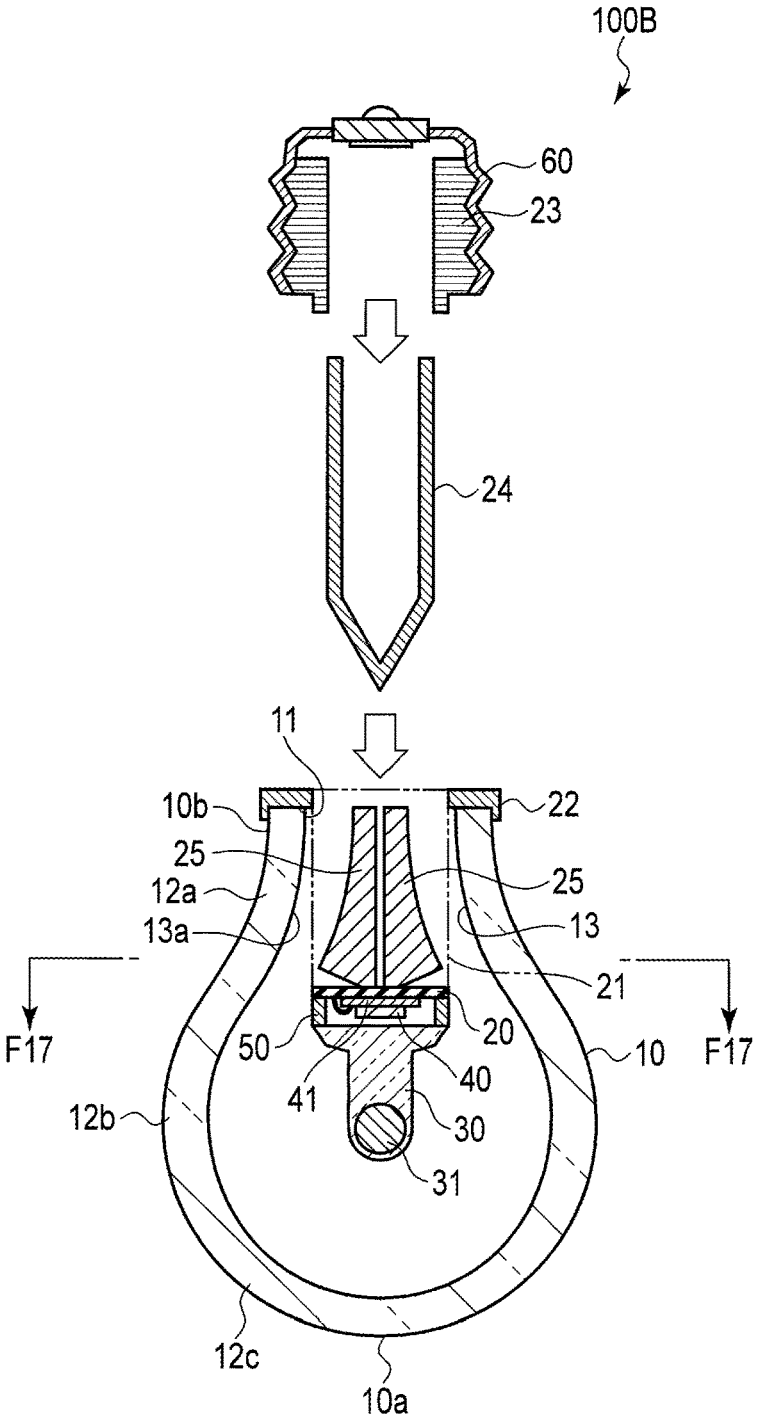
FIG. 15 is a cross-sectional view for explaining a method of assembling a lighting device according to a third embodiment.
Figure 16:
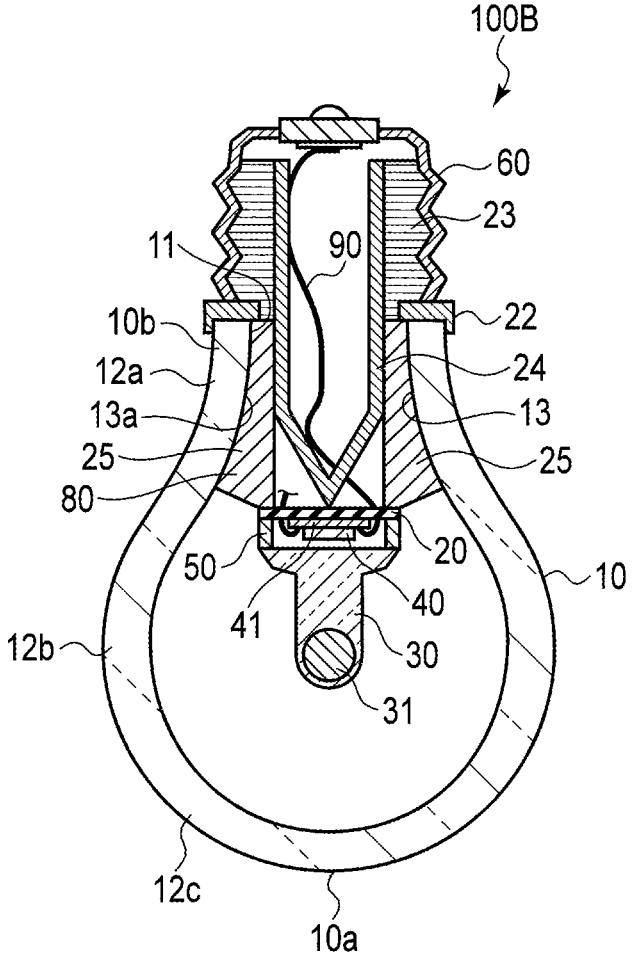
FIG. 16 is a cross-sectional view showing the lighting device shown in FIG. 15.
Figure 17:
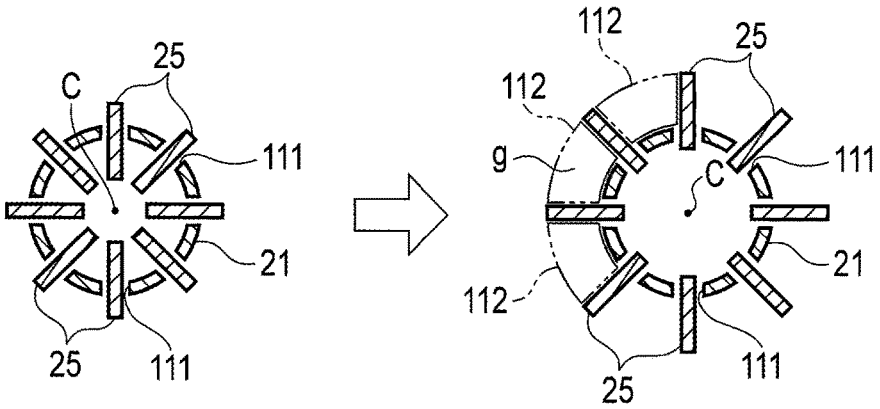
FIG. 17 is a cross-sectional view taken along line F17-F17 of fins incorporated in the lighting device shown in FIG. 15.

FIG. 15 shows a method of assembling a lighting device 100B according to a third embodiment. FIG. 16 shows the lighting device 100B assembled by the method shown in FIG. 15. FIG. 17 shows a cross section taken along line F17-F17 of fins shown in FIG. 15. The lighting device 100B is obtained by modifying the lighting device 100 of the first embodiment shown in FIGS. 1 and 2 such that the thermally conductive layer 80 is formed of a solid material, such as a synthetic resin, ceramics, glass, or a metal, instead of a gas.

The thermally conductive layer 80 of the third embodiment is formed of tabular fins 25 that are in contact with the inner surface 13 of the globe 10. The fins 25 are examples of "solid members." The fins 25 are inserted in slits 111 of the pillar 21 and supported by the pillar 21 such that they are developable (movable) toward the inner surface 13 of the globe 10. The fins 25 have outer shapes that, for example, meet the inner surface 13 of the globe 10. The fins 25 are formed of a transparent material, such as acryl, polycarbonate or glass, or a material of a high thermal conductivity, such as aluminum or copper. After the pillar 21 is inserted into the globe 10 through the opening 11, the fins 25 develops to contact the inner surface 13*a* of the enlarged portion 12*a* of the globe 10.

As shown in FIGS. 15 and 16, the lighting device 100B comprises a push member 24 configured to push the pillar 21 against the inner surface 13 of the globe 10 after the pillar 21 is inserted into the globe 10. The push member 24 has, for example, a tapered end portion, and is inserted between a plurality of fins 25. When the push member 24 is inserted between the fins 25, the fins 25 are pushed out to the inner surface 13 of the globe 10.

The lighting device 100B constructed as the above also exhibits an improved thermal dissipation performance like the lighting device of the first embodiment. In the third embodiment, the thermally conductive layer 80 is formed of the fins 25 that contact the inner surface of the globe 10, and hence can effectively transmit heat from the pillar 21 to the globe 10.

In the third embodiment, after the fins are inserted into the globe 10 through the opening 11, they develop to contact the inner surface 13*a* of the enlarged portion 12*a*. This structure enables the fins 25 to be brought into contact with the inner surface 13*a* of the enlarged portion 12*a* that has a greater circumferential length than the opening 11.

If a synthetic resin 112 (such as an adhesive) is injected between the fins 25, the pillar 21 and the globe 10 to be made a part of the thermally conductive layer 80 as shown in FIG. 17, the thermal resistance of the thermally conductive layer 80 can be further reduced, and the fins 25 can be made inconspicuous from the outside. In the third embodiment, the same diffusion sheet 98 as in the second embodiment may be attached to the inner surface 13 of the globe 10, the lateral surface 21*a* of the pillar 21, or the surfaces of the fins 25. If the globe 10 or the fins 25 are transparent, and if the synthetic resin 112 is also transparent, the synthetic resin 112 becomes inconspicuous to thereby improve the appearance. Further, if the globe 10 or the fins 25 are colored (for example, have a color of frost), and if the synthetic resin 112 is of the same color, the synthetic resin 112 becomes inconspicuous to thereby improve the appearance.

Figure 18:
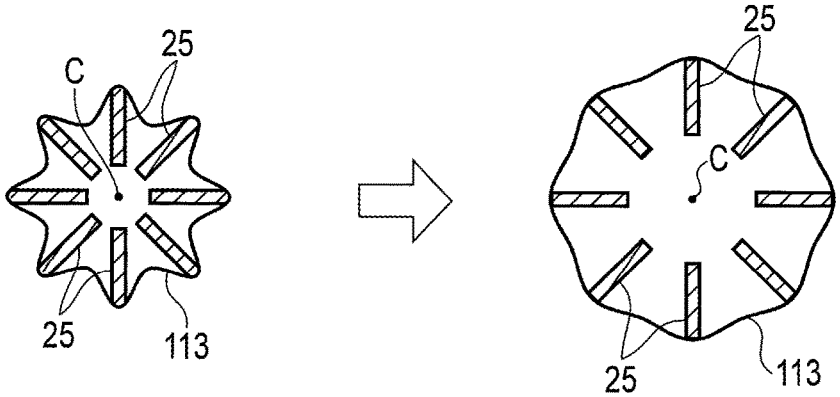
FIG. 18 is a cross-sectional view showing a modification of the lighting device shown in FIG. 15.

FIG. 18 shows a modification of the lighting device 100B shown in FIG. 15. In this modification, a flexible thermally conductive member 113 (for example, a thermally conductive sheet) may be attached to the outer surface of each fin 25. The thermally conductive member 113 is attached to, for example, the outer surfaces of the fins 25, and is opened in accordance with the deployment of the fins 25. If the thermally conductive member 113 is attached, it protects the fins 25 that contact the inner surface 13 of the globe 10, and makes the fins 25 inconspicuous from the outside.

Fourth Embodiment

Figure 19:
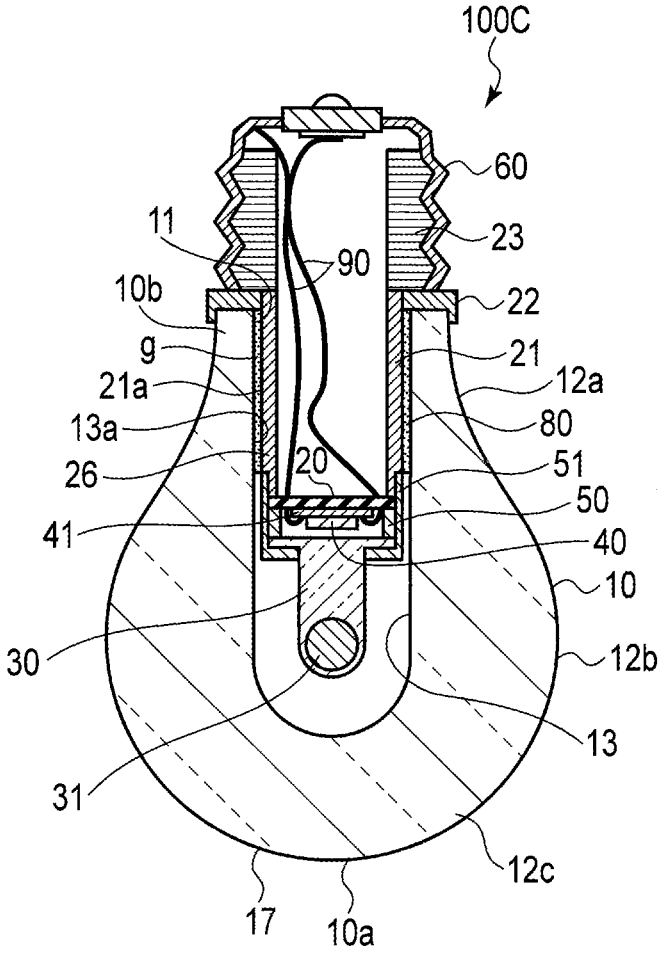
FIG. 19 is a cross-sectional view showing a lighting device according to a fourth embodiment.

FIG. 19 shows a lighting device 100C according to a fourth embodiment. The lighting device 100C is obtained by modifying the lighting device 100 of the first embodiment shown in FIGS. 1 and 2 such that the globe 10 has an uneven thickness.

More specifically, the globe 10 has the outer surface 17 and the inner surface 13. The outer surface 17 is formed, for example, substantially spherically like the outer surface 17 of the globe 10 of first embodiment. In the third embodiment, the inner surface 13 extends approximately linearly along, for example, the lateral surface 21*a* of the pillar 21 (the lateral surface 26*a* of the pillar portion 26). By making the diameter of a space, which defines the inner surface 13 of the globe 10, substantially constant from the opening 11 to the lateral surface of the lightguide column 30, the globe 10 is enabled to approach the pillar portion 26 without inserting a synthetic resin (for example, an adhesive) or the fins 25 (or reducing the amount of the synthetic resin or the size of the fins 25), thereby further reducing the thermal resistance between the globe 10 and the pillar portion 26.

In the third embodiment, the inner surface 13 of the enlarged portion 12*a* of the globe 10 has a portion substantially linearly extending along the lateral surface 21*a* of the pillar 21 (the lateral surface 26*a* of the pillar portion 26). This structure enables the globe 10 to be close to the pillar portion 26 without inserting a synthetic resin (adhesive) or the fins 25, even in the enlarged portion 12*a*.

Figure 20:
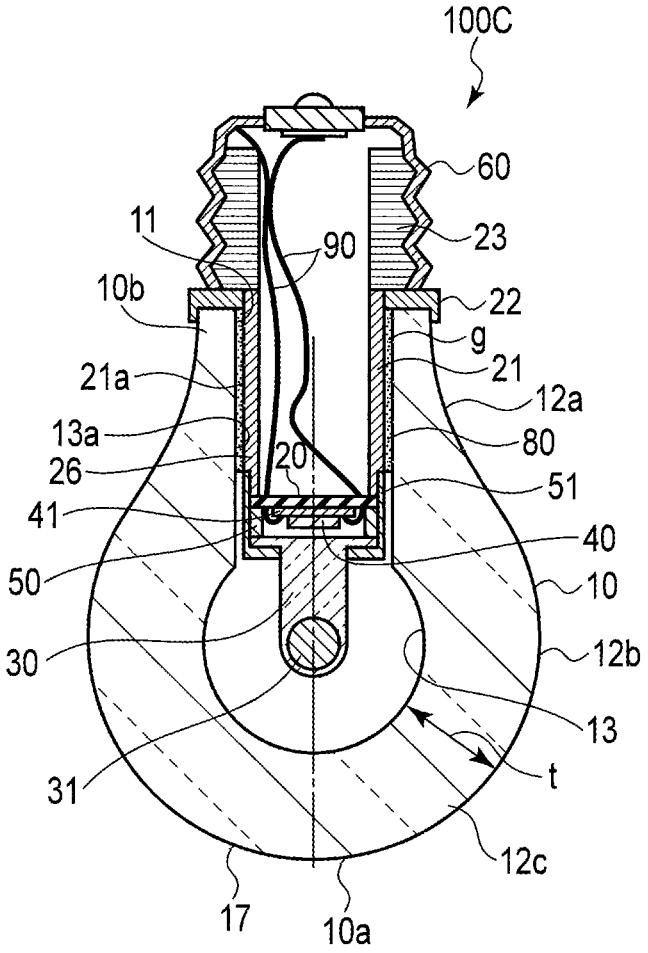
FIG. 20 is a cross-sectional view showing a modification of the lighting device shown in FIG. 19.

FIG. 20 shows a modification of the lighting device 100C of the fourth embodiment. In this modification, the shape of the globe 10 differs from the globe 10 of the lighting device 100C of the fourth embodiment shown in FIG. 19. In this modification, the diameter of a space, which defines the inner surface 13 of the globe 10, is made substantially constant from the opening 11 to the lateral surface of the lens connector 51, and the other portion of the globe 10 is made to have the same thickness t. This structure enables the globe 10 to approach the pillar portion 26 without inserting a synthetic resin (for example, an adhesive) or the fins 25, thereby reducing the thermal resistance between the globe 10 and the pillar portion 26 and further improving the appearance of the globe.

Fifth Embodiment

Figure 21:
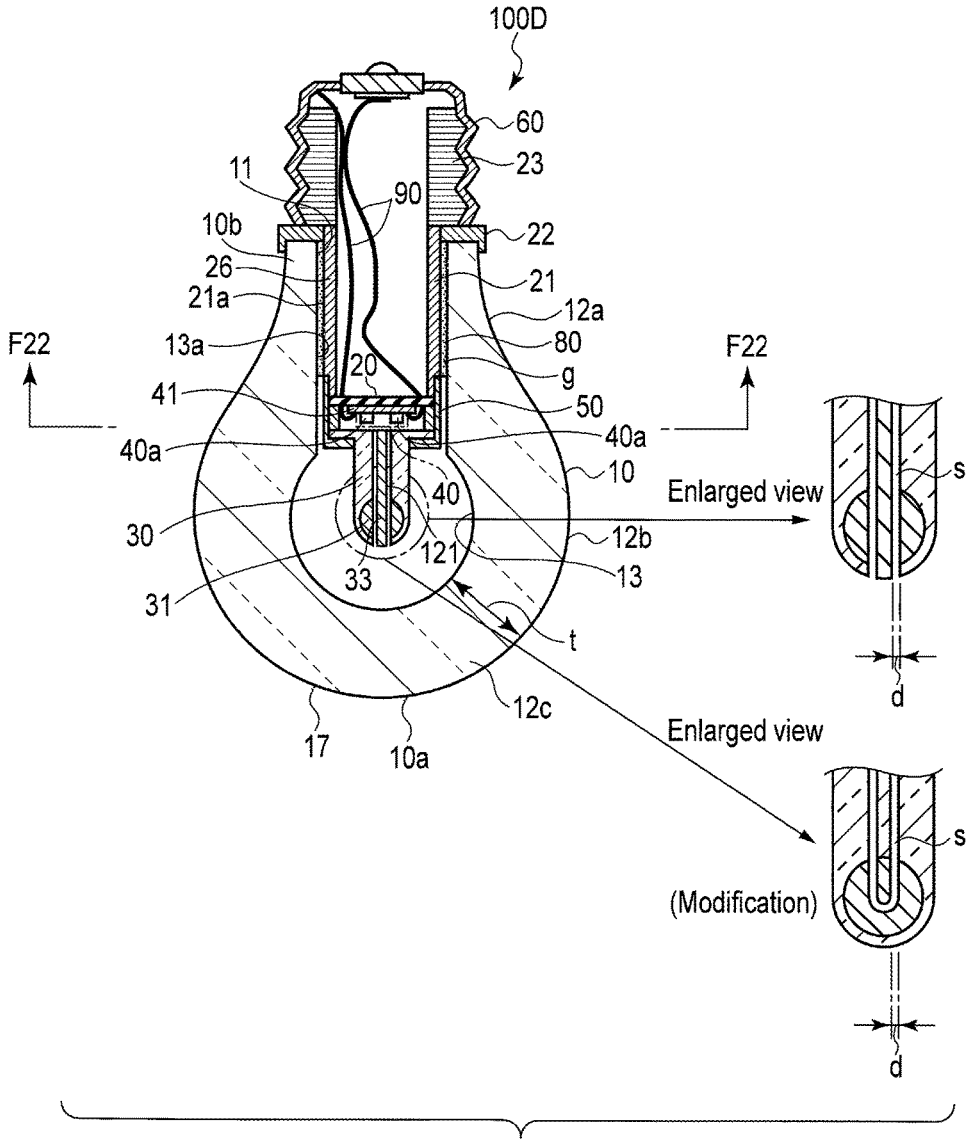
FIG. 21 is a cross-sectional view showing a lighting device according to a fifth embodiment.
Figure 22:
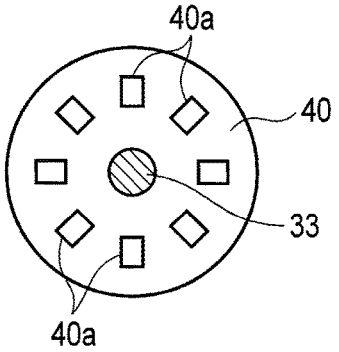
FIG. 22 is a cross-sectional view taken along line F22-F22 of a thermally conductive member shown in FIG. 21.

FIG. 21 shows a lighting device 100D according to a fifth embodiment. FIG. 22 is a cross-sectional view taken long line F22-F22 of the light source 40 shown in FIG. 21. The lighting device 100D is obtained by modifying the lighting device 100 of the first embodiment shown in FIGS. 1 and 2 such that the lightguide column 30 has a hole 121 extending along the axis thereof, and a thermally conductive member 33 formed of ceramic, glass or metal having a thermal conductivity higher than the base of the lightguide column 30 is inserted in the hole 121.

In the fourth embodiment, gaps s having width d are provided between the lightguide column 30 and the thermally conductive member 33. Width d is set, for example, not less than the wavelength λ of the light emitted by the light source 40. That is, width d of each gap s is set to satisfy following formula (24):

$$\lambda \leq d \tag{24}$$

FIG. 26 is a graph showing the relationship between d/λ and the reflectance assumed when the globe 10 and the pillar 21 are formed of acryl and aluminum, respectively, and total reflection occurs at an incident angle of 45° in the globe 10. It can be understood from FIG. 26 that when d/λ>1, i.e., d>λ, the reflection coefficient is almost 100%, while when d/λ<1, i.e., d<λ, part of light is absorbed by the pillar portion 26, and the reflection coefficient reduces when d reduces toward 0.

Therefore, in the lighting device 100D of FIG. 21, the reflectance of light transmitted through the lightguide column 30 can be made almost 100% by providing gaps s of width d not less than the wavelength of light between the inner surface of the lightguide column 30 and the lateral surface of the thermally conductive member 33. That is, most of the light transmitted through the lightguide column 30 can be extracted as illumination light from the outer surface, and loss of light resulting from the absorption of light by the thermally conductive member 33 can be reduced. This means that propagation of light to the thermally conductive member 33 due to an evanescent wave can be prevented to thereby reduce the loss of light. At this time, the thermally conductive member 33 can be made inconspicuous from the outside of the lighting device 100D, thereby improving the appearance of the device.

The thermally conductive member 33 is, for example, a pillar that extends through the lightguide column 30, and is in contact with the substrate 41 and hence thermally connected to the light source 40. A plurality of light emitting devices 40*a* included in the light source 40 are arranged annularly to surround the thermally conductive member 33.

The lighting device 100D constructed as the above exhibits an improved thermal dissipation performance like the device of the first embodiment. The lighting device 100D of the fifth embodiment further comprises a lightguide portion (lightguide column 30) located opposite to the pillar 21 with respect to the light source 40 and configured to pass light transmitted from the light source 40, and the thermally conductive member 33 provided in the lightguide portion and configured to guide a part of the heat produced by the light source 40 to the apex of the lightguide portion.

By providing the thermally conductive member 33 constructed as the above, the temperature of the lightguide column 30 can be further equalized, thereby promoting convection of gas between the lightguide column 30 and the globe 10, and further reducing the thermal resistance between the lightguide column 30 and the globe 10.

Figure 23:
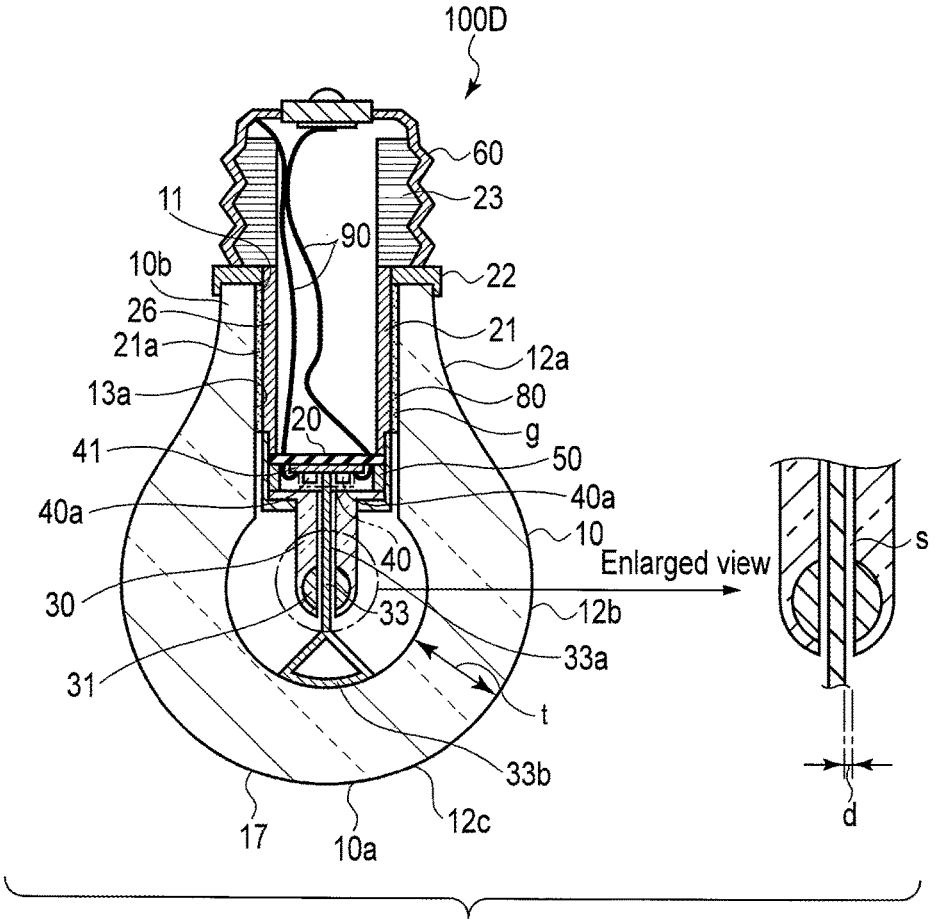
FIG. 23 is a cross-sectional view showing a modification of the lighting device shown in FIG. 21.

FIG. 23 shows a modification of the lighting device 100D of the fifth embodiment. In this modification, the thermally conductive member 33 projects from the lightguide column 30, and is in contact with the inner surface 13 of the globe 10. More specifically, the thermally conductive member 33 has a first portion 33*a* located in the lightguide column 30, and a second portion 33*b* located externally with respect to the lightguide column 30 and kept in contact with the inner surface 13 of the globe 10. The second portion 33*b* has an arcuate portion thicker than the first portion 33*a* and extending along the inner surface 13 of the globe 10. This structure further improves the thermal dissipation performance of the lighting device 100D.

Moreover, as in a modification shown in FIG. 21, the hole formed in the lightguide column 30 for inserting the thermally conductive member 33 does not always have to be a through hole. In this case, glaring at the end surface of the lightguide column 30 decreases, and the hemispherical end of the member 33 enhances the appearance.

Sixth Embodiment

Figure 24:
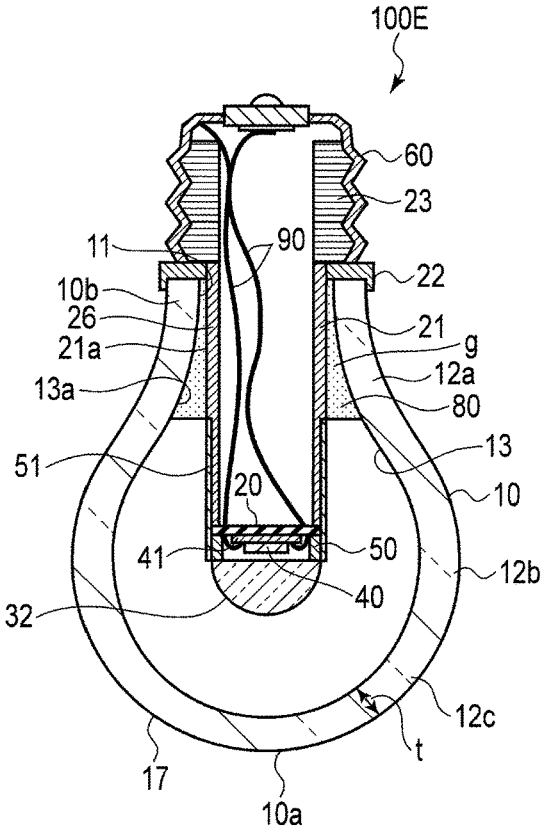
FIG. 24 is a cross-sectional view showing a lighting device according to a sixth embodiment.

FIG. 24 shows a lighting device 100E according to a sixth embodiment. The lighting device 100E is obtained by modifying the lighting device 100 of the first embodiment shown in FIGS. 1 and 2 to use a lens 32 instead of the lightguide column 30. The lens 32 is an example of the "lightguide member."

The lens 32 is a member formed of a material for passing light therethrough, such as glass or a synthetic resin, and reflects, deflects and diffuses light at surfaces thereof. Alternatively, the lens 32 may have a diffusion function by sealing therein particles of, for example, the diffusion member 31 for diffusing light.

Figure 25:
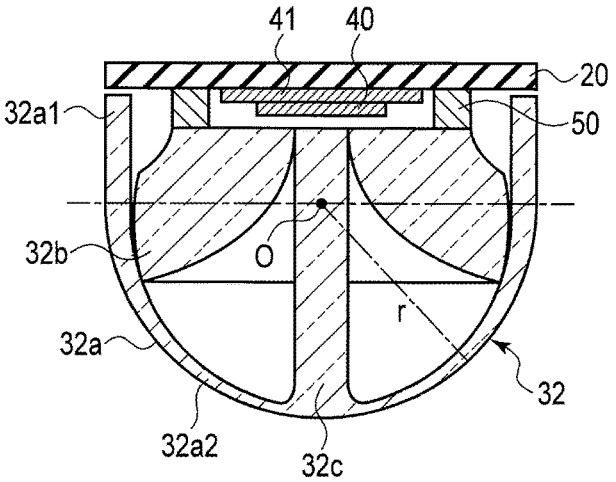
FIG. 25 is an enlarged cross-sectional view of a lens shown in FIG. 24.

FIG. 25 is a cross-sectional view showing a specific example of the lens 32. The lens 32 comprises a diffusion portion 32*a*, a total reflection portion 32*b* and a central portion 32*c*. The entire surface of the diffusion portion 32*a* serves as a diffusion surface. This diffusion surface is formed by, for example, sandblasting. However, the method of forming this surface is not limited to sandblasting, but may use, for example, white paint.

The diffusion portion 32*a* includes a cylindrical first portion 32*a*1, and a second portion 32*a*2 connected to the first portion 32*a*1 at a junction surface. The total reflection portion 32*b* is covered with the diffusion portion 32*a*, is entirely a mirror-finished surface. The central portion 32*c* is provided at the center of the total reflection portion 32*b*, and extends along the central axis from the light source 40 side to the diffusion portion 32*a*. Light emitted from the light source 40 to the central portion 32*c* passes through the central portion and the diffusion portion 32*a* to the outside of the lens.

The second portion 32*a*2 of the diffusion portion 32*a* has a hemispherical outer surface that has a center coinciding with the central point O of the above-mentioned junction surface. This outer surface is similar to the inner surface shape of the globe 10. That is, points on the inner surface 13 of the globe 10 are at substantially the same distance from corresponding points on the outer surface of the diffusion portion 32*a*. Further, the central point O is set to coincide with the center of the globe 10.

As a result, the light from the light source 40 is emitted from the central point O, i.e., the center of the globe 10. The maximum diameter of the diffusion portion 32*a* and the total reflection portion 32*b* is set not greater than the diameter of the opening 11 of the globe 10. As a result, the lens 32 can be inserted into the globe 10. It is preferable to use, as the material of the lens 32, acryl, polycarbonate, cycloolefin polymer, glass, etc., which have a high light transmissivity.

(Explanation of Function)

Referring now to FIG. 25, a description will be given of the function of the lens 32. The main component of the light emitted from the light source 40 is totally reflected by the upper surface (depressed surface) of the total reflection portion 32*b*, and is once emitted from the cylindrical lateral surface of the total reflection portion 32*b*. After that, the main component enters the diffusion portion 32*a*, and is diffused therein and passed therethrough. As a result, light is emitted rearward, namely, laterally and obliquely upward with respect to the emission direction of the light source 40 in FIG. 25.

Further, the light, which has not been totally reflected by the upper surface, namely, the depressed surface of the reflective portion 32*b*, passes through the upper surface of the reflective portion 32*b*, enters the diffusion portion 32*a*, and is diffused therein and passed therethrough. Thus, light is emitted forward, namely, in the emission direction of the light source 40.

Thus, the light emitted from the light source 40 is finally made to have a wide distribution by the diffusion portion 32*a*, and is diffused by and passed through the diffusion portion 32*a* with a uniform luminous intensity distribution.

Moreover, since the diffusion portion 32*a* has an outer surface similar to the inner surface shape of the globe 10, all portions of the outer surface are at substantially the same distance from the corresponding portions of the globe 10. As a result, the distribution property of the light emitted from the surface of the diffusion portion 32*a* is projected on the globe 10. This provides an advantage that if the luminous intensity distribution is uniform, the globe 10 appears to shine uniformly.

The maximum diameter of the diffusion portion 32*a* and the total reflection portion 32*b* is set not greater than the diameter of the opening 11 of the globe 10. As a result, the lens 32 can be inserted into the globe 10. In contrast, if the maximum diameter of the lens 32 is greater than the diameter of the opening 11 of the globe 10, it is necessary to work on, for example, divide, the globe 10. That is, the above feature exhibits an advantage that the load of working is reduced. Furthermore, the use of the lens 32 can realize a wide luminous intensity distribution even when a pillar 21 of a large diameter is used.

In addition, the maximum diameter of the lens 32 is smaller than the diameter of the opening 11 of the globe 10. This enables the lens 32 to be smoothly inserted into the globe 10.

Some of the above-described embodiments and modifications can be combined, and some elements included in them can be replaced appropriately. For instance, the thermally conductive layers 80 employed in the fourth to sixth embodiments and their modifications may be formed of gas as in the first embodiment, may be formed of a synthetic resin as in the second embodiment, may be formed of a solid member as in the third embodiment, or may be formed of other materials.

The above-described embodiments are presented just as examples, and are not intended to limit the scope of the invention. The embodiments may be modified in various ways without departing from the scope. For instance, various omissions, replacements, changes, etc., may be made. These embodiments and their modifications are included in the inventions recited in the claims and the equivalents of the inventions.

What is claimed is:

1. A lighting device comprising:

a hollow globe having an opening at an end thereof;

a light source housed in the globe and including at least an LED;

a pillar portion housed in the globe and supporting the light source;

a cap connector directly connected to the pillar portion, or indirectly connected to the pillar portion via another member; and a cap attached to the cap connector and electrically connected to the light source, wherein a thermally conductive layer is provided between an inner surface of the globe and a lateral surface of the pillar portion, and the thermally conductive layer comprises a gas positioned between the inner surface of the globe and the lateral surface of the pillar portion; and relationships given by the following formulas are satisfied:

$$d \leq \left(\frac{1400}{Gr_l}\right)^{\frac{1}{3.389}} l \tag{1}$$

$$Gr_l = \frac{g\beta(Tp - Tg)l^3}{\nu^2} \tag{2}$$

where d is a thickness of the thermally conductive layer, l is a length of a portion of the pillar portion which contacts the thermally conductive layer, β is a volume expansion coefficient of the gas, Tp is the lateral surface temperature of the pillar portion, Tg is an inner surface temperature of a region of the globe which contacts the thermally conductive layer, ν is a dynamic viscosity coefficient of the gas, and $Gr_l$ is a Grashof number.

2. The lighting device of claim 1, wherein a relationship given by the following formula is satisfied:

$$\lambda \leq d \tag{3}$$

where λ is a wavelength of light emitted from the light source.

* * * * *